US006561809B1

(12) United States Patent
Lynch et al.

(10) Patent No.: US 6,561,809 B1
(45) Date of Patent: May 13, 2003

(54) VIRTUAL BATTLEFIELD SIMULATOR SYSTEM AND METHOD

(75) Inventors: Randall G. Lynch, Lewisville, TX (US); Christie L. Lynch, Lewisville, TX (US)

(73) Assignee: Battlepaint, Inc., Lewisville, TX (US)

( * ) Notice: Subject to any disclaimer, the term of this patent is extended or adjusted under 35 U.S.C. 154(b) by 0 days.

(21) Appl. No.: 09/907,404

(22) Filed: Jul. 17, 2001

Related U.S. Application Data

(60) Provisional application No. 60/218,997, filed on Jul. 17, 2000.

(51) Int. Cl.[7] ..... F41G 3/26

(52) U.S. Cl. ..... 434/16; 434/22; 434/27; 463/1

(58) Field of Search ..... 273/311, 313; 434/16, 20, 21, 22, 27; 463/1

(56) References Cited

U.S. PATENT DOCUMENTS 5,454,720 A * 10/1995 Fitzgerald et al. ..... 434/27
6,106,297 A * 8/2000 Pollack et al. ..... 434/16
6,386,879 B1 * 5/2002 Varshneya et al. ..... 434/16

* cited by examiner

*Primary Examiner*—Denise L. Esquivel
*Assistant Examiner*—Melvin Jones
(74) *Attorney, Agent, or Firm*—Christopher J. Rourk; Akin Gump Strauss Hauer & Feld, LLP

(57) ABSTRACT

A computer controlled virtual battlefield simulator system that calculates virtual strikes on a playing field, such as a paintball playing field, that can eliminate players of the game by informing them via wireless communications that they have been eliminated from play. The system also tracks player movements on the field, the amount of virtual supplies and virtual support services the players and teams have in their possession. A player's equipment may include a wireless Tracking and Elimination Device that is carried on the person and is used to communicate with the computer system. Portable Arming Devices are located on the objectives for the players to arm, disarm, or repair the objective using their Tracking and Elimination Devices.

20 Claims, 25 Drawing Sheets

Receiving Antenna [1]
DGPS Beacon [63]
Transmitting Antenna [62]
Receiving Antenna [1]
Base Camp
Repeater [5]
Repeater [5]
Receiving Antenna [1]
VBS Computer System [15]
Transmitting Antenna [62]
Receiving Antenna [1]
Transmitting Antenna [62]
Player with TSD [3]
Receiving Antenna [1]
Playing field [19]

DGPS Beacon [63]
Base Camp
Receiving Antenna [1]
VBS Computer System [15]
RF Link
Hardwired
Transmitting Antenna [62]
PAD [2]
RF Link
Playing field [19]

Base Camp
VBS Application Servers (15)
Receiving Antenna [1]
Send TED [3] ID to VBS
Request TED [3] ID
Referee or commander with WWC [4]
Player with TED [3]
Receive player information from VBS
Transmitting Antenna [62]
Send elimination signal to TED [3]
Playing field [19]

Receiving Antenna [1]
Repeater [5]
PAD [2]
RF Link
Objective [50]
Infrared sensor switch [47]
Laser beam [48]
Player with laser [49]
Transmitting Antenna [62]
Playing field [19]

VBS Computer System [15]
Receiving Antenna [1]
Virtual Supply (VSA) used in Virtual Support Service (VSS) Strike [52]
Player [51]
Speakers [44]
Speakers [44]
Wait State
Pyrotechnics [46]
Objective with PAD [53]
Airfield [54]
Playing field [19]
Virtual Field Sector [43]
Transmitting Antenna [62]

VBS Computer System [15]
Receiving Antenna [1]
Chemical Fall Out Trajectory [56]
Virtual Chemical Weapon [55]
Player [51]
Wait State
Speakers [44]
Speakers [44]
Pyrotechnics [46]
Objective with PAD [53]
Virtual Field Sector [43]
Transmitting Antenna [62]
Playing field [19]

VBS Computer System [15]
Receiving Antenna [1]
Teams Country Border [57]
Nuclear Missile Silo [59]
Virtual Nuclear Missile [58]
Wait State
Players [51]
Nuclear Defense Missile Silo [60]
Playing field [19]
Transmitting Antenna [62]
Objective with PAD [53]

VBS Computer System [15]
Receiving Antenna [1]
Players [51]
Speakers [44]
Speakers [44]
Players [51]
PAD [2]
VMF [61]
Virtual Field Sector [43]
Playing field [19]
Transmitting Antenna [62]

VIRTUAL BATTLEFIELD SIMULATOR SYSTEM AND METHOD

RELATED APPLICATIONS

The present application is related to and claims priority to U.S. Provisional application No. 60/218,997, "Virtual Battlefield Simulator System and Method," filed Jul. 17, 2000, Randal G. Lynch and Christie L. Lynch, inventors, which is hereby incorporated by reference for all purposes.

CROSS-REFERENCE TO RELATED APPLICATIONS

This application is related to U.S. patent application Ser. No. 09/907,380 entitled "System and Method for Player Tracking" filed on Jul. 17, 2001, which is currently pending and commonly owned with the present application.

FIELD OF THE INVENTION

The present invention pertains to the field of player tracking systems. More specifically, the invention relates to a system and method for tracking players that allows player location data to be used to provide game functionality.

BACKGROUND OF THE INVENTION

Children have been playing a form of paintball for hundreds of years, it's called tag. Paintball is nothing more than a grown-up version of tag. The paintball represents the "tagging device" and the paintball marker is the tool used to deliver the "tagging device" to the opponent. Another game played by children is called "sock wars". This game utilizes rolled-up socks that are used by children to tag each other by throwing the rolled-up socks at one another in hopes of taking an objective that was predefined before the game began. A participant struck by the rolled-up socks is eliminated from the game. In effect, this game is also the same as paintball, only the devices used and the age of the players have changed. People have always been fascinated with the challenge of battle. The strategy of overcoming odds to overthrow an opponent is an integrated part of human nature and is found in both men and women. This may be illustrated by games such as chess, poker, football, soccer, basketball, and many others. These games incorporate the same desires that paintball players seek, a strategic and challenging battle of friendly competition.

Paintball requires participants to use their imagination to come up with ways to simulate military support services such as air strikes, artillery barrages, and destruction of objectives. For example, the throwing of a smoke grenade into an area may be used to simulate an air strike or artillery barrage that requires all players to vacate a predetermined radius, such as 100 feet. Another example includes securing a ribbon around an objective to show that the objective has been destroyed. Unfortunately, imagination only goes so far and most military support services can only be crudely modeled and simulated in paintball.

BRIEF SUMMARY OF THE INVENTION

The present invention relates to an amusement game or extreme sport played with paintball marking devices in which players and/or teams are trying to win a battle played out on a playing field. In addition to the paintball marking devices, the present invention provides a Virtual Battlefield Simulator (VBS) system and method that utilizes a computer system and one or more wireless technologies to allow players to compete with other players and teams to eliminate opposing players and objectives using realistic Virtual Support Services (VSS) and Virtual Supply Arsenals (VSA) as well as track various statistics such as the players' lives or eliminations, remaining virtual supplies, and the score of the game. The VSS may include virtual air strikes, virtual air defense systems, laser targeting of objectives (Pickling), virtual artillery barrages, virtual minefields, virtual cruise missiles, virtual chemical weapons, virtual nuclear missiles, and virtual nuclear defense missiles. The VSA may include virtual aircraft's, virtual air-to-ground missiles, virtual surface-to-air missiles, virtual air defense systems, virtual free fall bombs, virtual artillery guns, virtual artillery shells, virtual cruise missiles, virtual land mines, virtual detonation charges, virtual engineer supplies, virtual player lives, virtual nuclear missiles, virtual nuclear defense missiles, and virtual chemical weapons. The players and teams have the capability to request VSS, which result in computer generated attacks (or simulations) on the playing field. Preferably, audio simulations will be generated at speakers located at or near the specified location of the VSS. The damages caused by these attacks are calculated by the computer system and the players on the field are then informed of the outcome through the use of wireless devices that the players carry and special effects on the field.

The playing field may exist indoors or outdoors and radio frequency telemetry technology is preferably used to electronically communicate with the player's wireless Tracking and Elimination devices (TED) and the objectives (PAD) on the playing field. In one embodiment, the playing field may be broken into virtual field sectors to allow the computer system to trigger activities in desired sectors, such as sound effects, lighting effects, and pyrotechnics, while not affecting surrounding or other virtual field sectors of the playing field. The virtual field sectors are only visible to the computer system and not to the players, although the players TED may inform the players of their current location by displaying the virtual field sector location or geographic coordinates. The TED may include an LCD sector/virtual players live (VPL) display. Any of a variety of wireless or radio frequency telemetry technologies may be used in the present invention, such as radio telemetry, radio triangulation, Global Positioning Systems (GPS), Differential Global Positioning Systems (DGPS), spread spectrum technologies, Time Difference of Arrival (TDOA), and Angle of Arrival (AOA) technology. The present invention may be implemented for indoor use or for outdoor use on large areas of land, such as hundreds of acres of land to simulate a virtual/real battlefield setting.

The computer controlled VBS system of the present invention will enhance the challenge, strategy and realism to this amusement game and extreme sport by providing realistic VSS and VBS. The VBS system also allows players and teams to locate Field Supply Stashes (FiSS) in the field that can contain virtual supplies for the team to add to the VSA. This system will also deliver special effects to the field in the form of sound, lighting and pyrotechnics. The VBS system will also score the game in real time, track the player's movement on the field in real time, and provide the ability for the referee or commanders to eliminate players on the field using the VBS system.

DETAILED DESCRIPTION OF THE INVENTION

Figure 1:
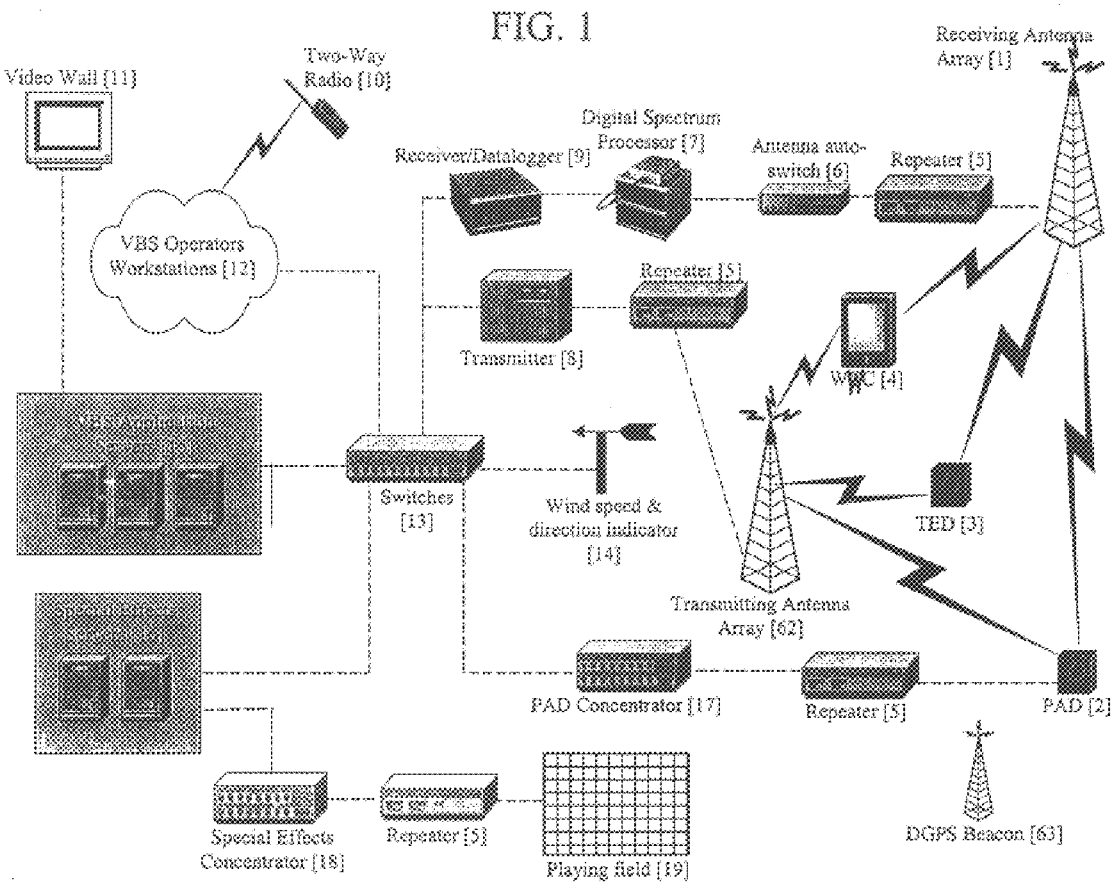
FIG. 1 is a schematic diagram of an exemplary computer controlled Virtual Battlefield Simulator (VBS) system.

Referring to FIG. 1, a schematic diagram of an exemplary computer controlled Virtual Battlefield Simulator (VBS) system infrastructure is illustrated. The exemplary embodiment of FIG. 1 can be modified where suitable to provide functionality of the present invention in other suitable environments and applications. The VBS system radio frequency receiving antennas [1] and radio frequency transmitting antennas [62] are used to communicate with the objectives PAD [2], players TED [3], referees and commanders WWC [4]. Receiving antennas [1] are placed around the playing field [19] for better reception of the signal. The system may utilize a fast antenna auto-switching device [6] and a Digital Spectrum Processor [7]. This allows the system to optimize and simultaneously detect a fixed set of 25 channels or frequency's, spaced, for example, 20 kHz apart. This allows all the transmitting devices to be monitored virtually simultaneously. The signal is then sent to the Receiver/Datalogger [9], which determines the receiving antenna [1] it was received from, and using GPS and DGPS beacon [63] or Time Difference of Arrival (TDOA) and Angle of Arrival (AOA), and the position of the transmitting device, i.e. PAD [2], TED [3], or WWC [4] on the playing field [19]. The Receiver/Datalogger [9] can track up to 170 transmitters per frequency. This means that 4,250 transmitters can be tracked with this system simultaneously.

Once the signal has been processed by the Receiver/Datalogger [9], this data is then sent to a bank of switches [13] that will carry the data to the VBS Application Servers [15]. The VBS Application Servers [15] are running an application that interprets the data it has received from the Receiver/Datalogger [9] and stores that data in memory. Thus the application running on the VBS Application Servers [15] knows the location of all transmitting devices on the playing field [19].

Several VBS Operator Workstations [12] are connected to the VBS Application Servers [15] via switches [13] to allow the games parameters to be programmed into the VBS Application Servers [15] application before and or during the games execution. This allows for every game to be dynamic. These parameters consist of: The Virtual Supply Arsenal (VSA) for each player and team. These virtual supplies consist of: Virtual aircraft (VAC), Virtual air to ground missiles (VAGM), Virtual surface to air missile (VSAM), Virtual air defense systems (VADS), Virtual free fall bombs (VFFB), Virtual artillery (VAT), Virtual cruise missiles (VCM), Virtual land mines (VLM), Virtual detonation charges (VDC), Virtual engineer supplies (VES), Virtual player lives (VPL), Virtual nuclear missiles (VNM), Virtual nuclear defense missiles (VNDM), Virtual chemical weapons (VCW), players elimination time, what the objectives are, objective point values, and Field Supply Stashes (FiSS) values. The operators also design the game by supplying wait states (the amount of time for a Virtual Support Service to reach its target) i.e. how long it takes for a VAC to reach its target before releasing its VFFB, or how long the wait is from the arming of an objectives charges to detonate. These operators can also be used to activate Virtual Support Services (VSS) if the VSS was requested via two-way radio [10] and not via the Wireless Workstation Centers (WWC) [4].

The VBS Application Servers [15] also perform the following: continually calculating the current game score, current objective possession, and player elimination time. Virtual Support Services (VSS) are called in by a player on the playing field [19] using a two-way radio [10] or Wireless Workstation Center (WWC) [4]. If the VSS was requested via two-way radio [10], the VBS operators check the teams Virtual Supply Arsenal (VSA) to verify if the VSA is available. If the VSA is available then the VBS Operator submits the VSS to the VBS Application Servers [15]. The VBS Application Servers [15] then perform the Virtual Support Service (VSS) and calculates its outcome using random number generators programmed into the VBS Application Servers [15] application. If the VSS consisted of a Virtual Chemical Weapon (VCW), the VBS Application Servers [15] utilize data retrieved by the wind speed and direction indicators [14] located on the playing field [19] to determine the wind speed and direction of the fall out that will occur from the weapon in its calculations. Instead of requesting a VSS using the two-way radios [10], the commanders can use their Wireless Workstation Center (WWC) [4] to request a VSS directly from the VBS Application Servers [15]. This will be discussed later in this section in connection with the WWC capabilities.

Virtual Support Services (VSS) may include, in one embodiment, one or more of the following: Virtual Air Strikes (VAST), Virtual Air Defense Systems (VADS), Virtual Artillery Barrages (VAB), Virtual Minefields (VMF), Virtual Cruise Missiles (VCM), Virtual Chemical Weapons (VCW), Virtual Nuclear Missiles (VNM), and Virtual Nuclear Defense Missiles (VNDM).

Once the VSS calculations have completed on the VBS Application Servers [15], the VBS Application Servers [15] send signals out to the affected devices on the field in the following manner: if a player was eliminated during the VSS, a signal is transmitted to the players TED [3] via a transmitter [8] and the transmitting antenna array [62]. If an objective was destroyed during the VSS then either a signal is sent to the objectives PAD [2] via a transmitter [8] and the transmitting antenna array [62] or a signal is sent to the objectives PAD [2] via category 5 UTP, coaxial cable, or fiber optic cable to a PAD Concentrator [17] then through repeaters [6] to the objectives PAD [2]. If the VSS requires sound effects, lighting, or pyrotechnics to be used, then the VBS Application Servers [15] send to the Special Effects Servers [16], the appropriate effect devices that need to be activated and or which sounds to be played, which in turn activates that special effect device on the field such as speakers [44], lighting [45], or pyrotechnics [46]. This activation of the special effects device may occur, in one embodiment, by sending a signal to the special effects device on the playing field [19] from the Special Effects Servers [16] over category 5 UTP wire, coaxial cable, fiber optic cable, or a wireless communications link to a Special Effects Concentrator [18] then from the concentrator to repeaters [6] then to the special effects device on the playing field [19].

Figure 2:
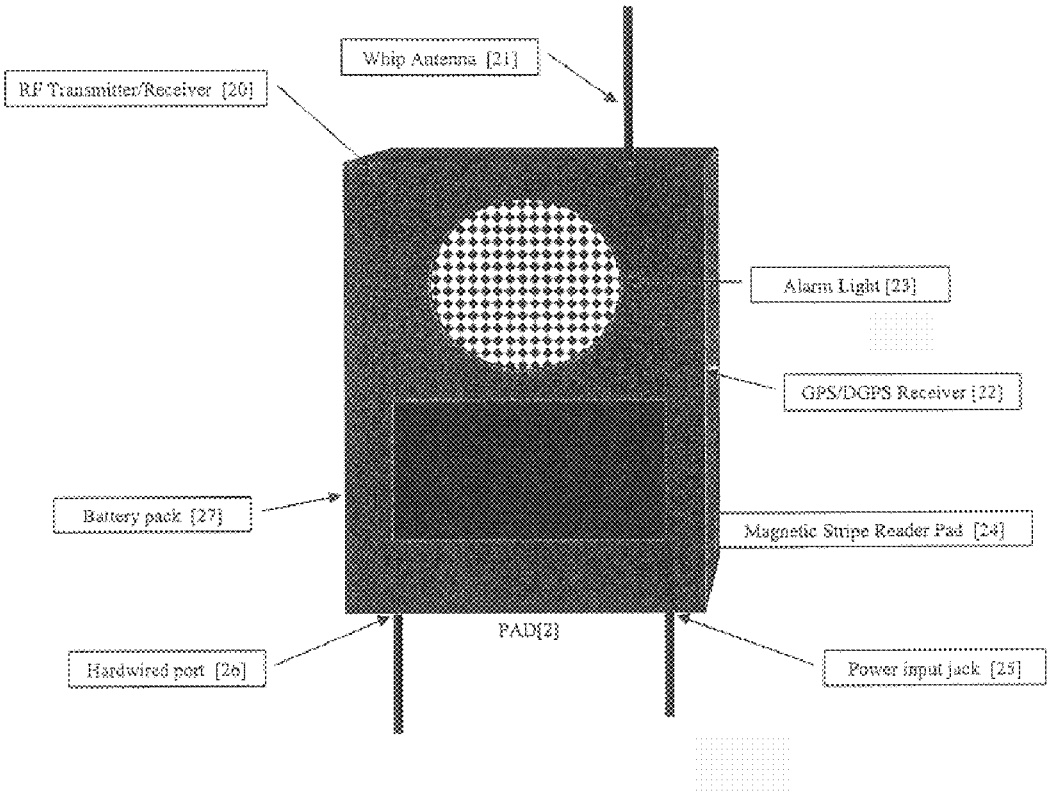
FIG. 2 is a view of an exemplary Portable Arming Device (PAD) [2] placed on objectives and triggered by the players TED [3] to arm or unarm the device for detonation. This device is also used to retrieve Virtual Supplies from a Field Supply Stash (FiSS) and arm or disarm Virtual Minefields (VMF)

Referring to FIG. 2, a view of an exemplary Portable Arming Device (PAD) [2] that is placed on objectives or in the playing field [19] to be used by the players to activate a detonation of an objective, repair a destroyed objective, take possession of an objective, disarm or arm Virtual Minefields, or obtain VSA from a FiSS. The exemplary embodiment of FIG. 2 can be modified where suitable to provide functionality of the present invention in other suitable environments and applications. Each PAD [2] has a unique identification number that is transmitted to the VBS Application Servers [15] along with a players TED [3] identification number if a player has swiped their TED [3] magnetic stripe [34] to the PAD [2] magnetic stripe reader pad [24]. The PAD [2] may include a Radio Frequency Transmitter/Receiver [20] used to send and receive information to the VBS Application Servers [15] via the receiving antenna array [1] and transmitting antenna array [62], a Whip Antenna [21] used to increase the range of the signal and enhance reception to the PAD [2], a GPS/DGPS Receiver [22] used to locate the position of the PAD [2] on the playing field [19], an Alarm light [23] used to inform the players on the playing field [19] that the objective is armed for detonation (amber light) or that the objective is destroyed (red light) or that the objective is repaired or in good condition (green light), a Magnetic Stripe Reader pad [24] used to activate the PAD [2] for detonation or rebuilding using the players TED [3], a Power input jack [25] used to provide power to the PAD [2] if power is available to the PAD [2], a Hardwired Port [26] used to connect the PAD [2] to the VBS Application Servers [15] if the PAD [2] does not use wireless communications, and a Battery Pack [27] used to provide power to the PAD [2] if no power is available to the unit via the Power input jack [25].

Figure 3:
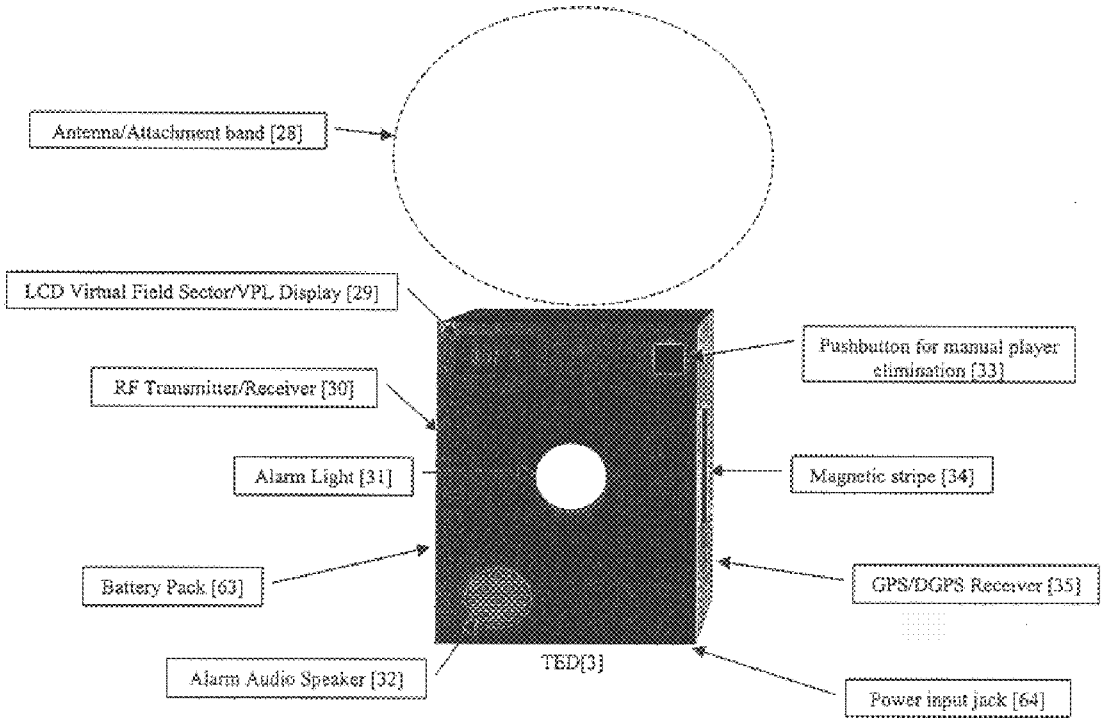
FIG. 3 is a view of an exemplary wireless Tracking and Elimination Device (TED) [3] that communicates with the VBS Application Servers [15], and Portable Arming Devices (PAD) [2]. This device gives the player vital information on the playing field [19] as well. This device, in one embodiment, is carried on the player's person during the game.

Referring to FIG. 3, a view of an exemplary wireless Tracking and Elimination Device (TED) [3] that the players carry on their person during the game is provided. The exemplary embodiment of FIG. 3 can be modified where suitable to provide functionality of the present invention in other suitable environments and applications. This unit allows the VBS Application Severs [15] to communicate with the player on the playing field [19] via the transmitting antenna array [62] as well as letting the player communicate with the VBS Application Servers [15] via the receiving antenna array [1]. Using GPS and DGPS or Time Difference of Arrival (TDOA) or Angle of Arrival (AOA) the TED [3] can also transmit the TED [3] position to the VBS Application Servers [15]. This device informs the players of several things including the current Virtual Field Sector [43] they are in, how many Virtual Player Lives (VPL) they have left in the game, and if they have been eliminated from play. The TED [3] is also used by the player to arm, disarm, or rebuild an objective by swiping the Magnetic Stripe [34] to the Magnetic Stripe Reader Pad [24] of the PAD [2]. The player may also receive Virtual Supplies to add to the team's arsenal or their own personal Virtual Supply by swiping a PAD [2] magnetic reader pad [24] located on a FiSS with their TED [3] magnetic stripe [34]. The TED [3], in one embodiment, may include an antenna/attachment band [28] used to attach the device to a player on the playing field [19]

as well as enhance the signal for communication with the wireless systems, an LCD Sector/VPL Display [29] used to display the current Virtual Field Sector [43] the player is located in, and display the number of Virtual Player Lives (VPL) the player has left in the game, a Radio Frequency Transmitter/Receiver [30] used to transmit and receive the wireless signal needed to communicate with the VBS Application Servers [15], an Alarm Light [31] used to emit a bright light to show other players on the playing field [19] that the player wearing the device is out of play, an Alarm Audio Speaker [32] used to emit a loud tone to inform the other players on the playing field [19] that the player wearing the device is out of play, a pushbutton for manual player elimination [33] used by the player to eliminate themselves from play if they are eliminated by another player on the playing field [19] this button will activate the Alarm Light [31] and Alarm Audio Speaker [32] and since the VBS Application Servers [15] check the status of the TED [3] every second it will be updated to reflect that the player has eliminated themselves from play, Magnetic Stripe [34] used to arm, disarm, rebuild, or add Virtual Supplies to their own or the teams Virtual Supply Arsenal (VSA) from a Field Supply Stash (FiSS) that is found on the playing field [19], and, in one embodiment, a GPS/DGPS receiver [35] used to calculate the position of the TED [3] on the field. Other embodiments may not require the GPS/DGPS receiver 35, but instead use local or non-satellite location technology, such as those that implement spread spectrum, Time Difference of Arrival (TDOA), and/or Angle of Arrival (AOA) technologies.

Figure 4:
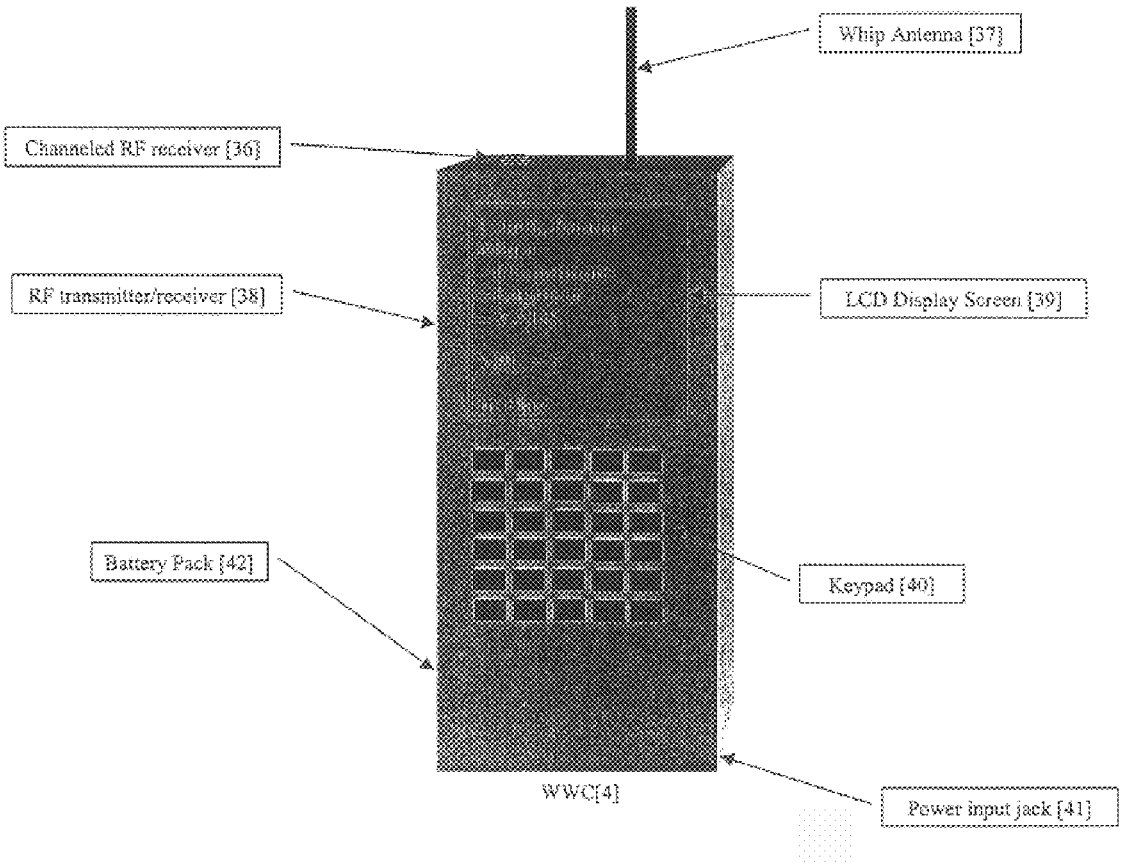
FIG. 4 is a view of an exemplary Wireless Workstation Center (WWC) [4] that is used by the referees and commanders on the playing field [19] during the game to: (i) activate players Tracking and Elimination Devices (TED) [3] on the playing field [19] if the player has been tagged by another players marker and the player tagged did not activate their TED [3] manually; (ii) to retrieve information about a player on the field from the VBS Application Servers [15] such as the players name, rank, specialties, virtual player lives (VPL) left, and if the player is currently in the game; (iii) for the commander to retrieve information about their current teams Virtual Supply Arsenal (VSA), current number of players not eliminated on their team, current game score, and current objectives they are in possession of and condition of that objective; and (iv) request Virtual Support Services (VSS) from the VBS Application Servers [15]
Figure 9:
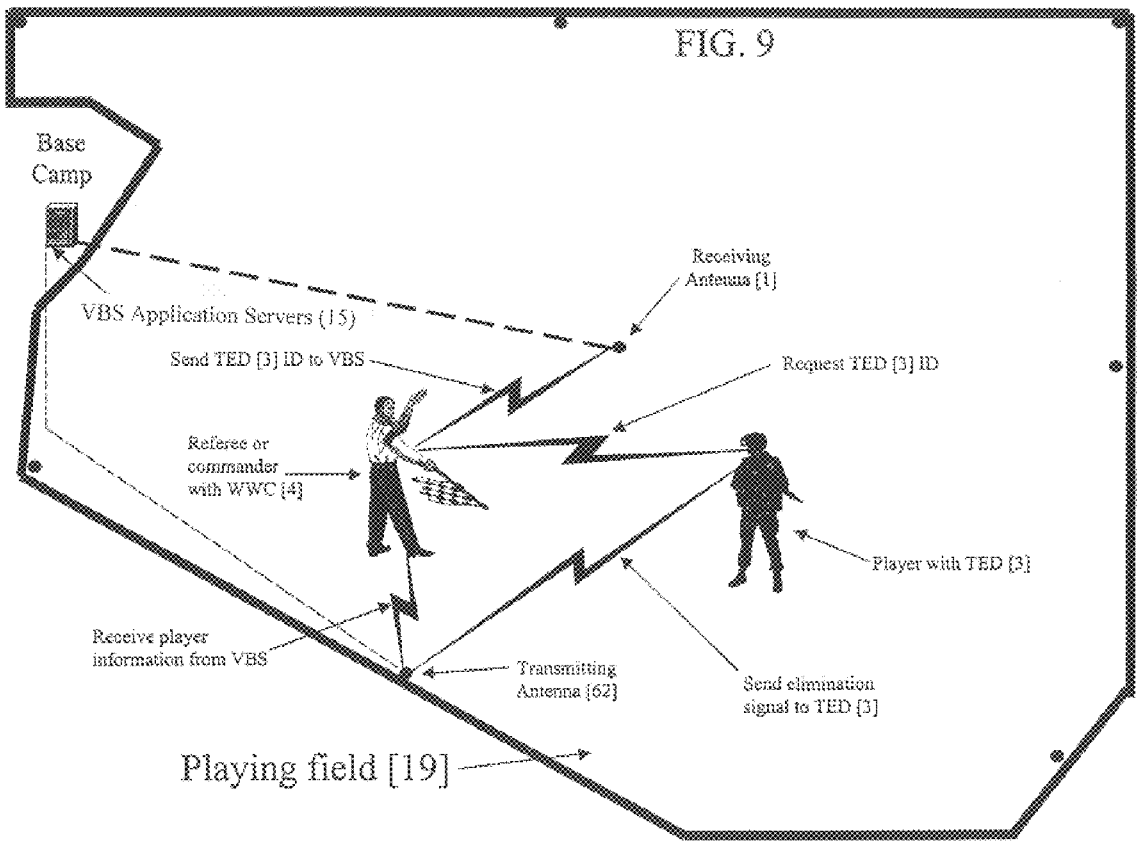
FIG. 9 is a view showing an example of how a referee or commander on the playing field [19], using their Wireless Workstation Center (WWC) [4], can retrieve information about a player on the field, eliminate a player from play, or reverse a players elimination.

Referring to FIG. 4 and FIG. 9, a view of an exemplary Wireless Workstation Center (WWC) [4] that the referees and commanders carry on their person to gather information about a player on the playing field [19] from the VBS Application Servers [15], eliminate or reverse eliminate a player on the playing field [19], view their current Virtual Supply Arsenal (VSA), request Virtual Support Services (VSS) directly from the VBS Application Servers [15], monitor how many players are currently eliminated on the their team, view the current game score, and view the current possession of an objective. The exemplary embodiments of FIG. 4 and FIG. 9 can be modified where suitable to provide functionality of the present invention in other suitable environments and applications.

To gather information about a player, the referee or commander points the WWC [4] at a player in question and presses a key on the WWC [4] keypad [40], which, in one embodiment, uses the Channeled Radio Frequency Receiver [36] to capture the players TED [3] identification number that is being transmitted to the VBS Application Servers [15] once a second. Once the TED [3] identification number is captured by the WWC [4], the WWC [4] transmits the WWC [4] identification number and the players TED [3] identification number to the VBS Application Servers [15] via radio frequency to the receiving antenna array [1] with a request for information on the identified player. The VBS Application Servers [15] retrieve the queried data and transmit the information about the player, via the transmitting antenna array [62], back to the appropriate WWC [4] and the data is displayed on the WWC [4] LCD Display [39], as is illustrated in FIG. 4.

The WWC [4] may be used to eliminate a player from play or reverse a player's elimination. To achieve this, the referee or commander requests the players TED [3] identification number by pointing the WWC [4] at the player in question. This may be achieved by activating the Channeled Radio Frequency Receiver to capture the TED [3] identification number that is being transmitted once a second to the VBS Application Servers [15]. Once the WWC [4] has captured the players TED [3] identification number, the WWC [4] can then transmit this identification number as well as their WWC [4] identification number to the VBS Application Servers [15] via the receiving antenna array [1] with a request that the player is eliminated from play or with a request that the players elimination be reversed. The VBS Application Servers [15] then transmits the appropriate code to the players TED [3] via the transmitting antenna array [62].

The WWC [4] may be used by a team commander to request information about a teams current Virtual Supply Arsenal (VSA) directly from the VBS Application Servers [15]. To accomplish this, the commander requests information about their current VSA by entering into the WWC [4] keypad [40] the VSA they are requesting information about and then submitting this request to the VBS Application Servers [15] using radio frequency through the receiving antenna array [1]. The VBS Application Servers [15] then retrieve the queried results and transmit this information to the WWC [4], via the transmitting antenna array [62], where it is displayed on the LCD Display [39].

The WWC [4] may also be used by a team commander to request Virtual Supply Services (VSS) directly from the VBS Application Servers [15]. To accomplish this, the commander requests one or more VSS by entering into the WWC [4] keypad [40] the requested VSS and the Virtual Field Sector [43] and coordinates of that Virtual Field Sector [43] for the strike to take place. Once this data is entered into the WCC [4], the commander can submit their request to the VBS Application Servers [15] via the receiving antenna array [1] for activation of the VSS.

The WWC [4] may, in one embodiment, be used to monitor how many players are currently eliminated on their team. The WWC [4] receives the current number of eliminated players on a commanders team periodically, such as every 5 minutes, from the VBS Application Servers [15] using radio frequency through the transmitting antenna array [62].

The WWC [4] may view the current game score by receiving the current game score periodically, such as every 15 minutes, from the VBS Application Servers [15] using radio frequency through the transmitting antenna array [62]. The current possession of an objective may be viewed by a commander using the WWC[4] by requesting the current possession of an objective from the VBS Application Servers [15] by entering in the Virtual Field Sector [43] the objective is in and submitting this query to the VBS Application Servers [15] via radio frequency through the receiving antenna array [1]. The VBS Application Servers [15] receive the query and then transmit the data back to the WWC [4] via radio frequency using the transmitting antenna array [62]. The data is then displayed on the WWC [4] LCD Display [39]. Any of a number of other functions could additionally be implemented in the WWC [4].

The WWC [4], in one embodiment, may include a Channeled Radio Frequency Receiver [36] used to retrieve a players TED [3] identification number and is only channeled when the referee or commander initiates the receiver to be channeled (this allows the receiver to be pointed at a specific TED [3] and capture the identification number being transmitted by the TED [3]), a Whip Antenna [37] used to enhance the signal strength used to communicate with the VBS Application Servers [15] through the receiving antenna array [1] and transmitting antenna array [62], a Radio Frequency Transmitter/Receiver [38] used to communicate with the VBS Application Servers [15] through the receiving antenna array [1] and transmitting antenna array [62], an LCD Display screen [39] used to display the data received by the VBS Application Servers [15] to the referee or commander, a Keypad [40] used by the referee or commander for submitting manually input data to the VBS Application Servers [15] for performing actions listed above, a Power Input Jack [41] used to apply power to the WWC [4] for recharging the Battery Pack [42], and a Battery Pack [42] used to power the WWC [4] while on the playing field [19].

Figure 5:
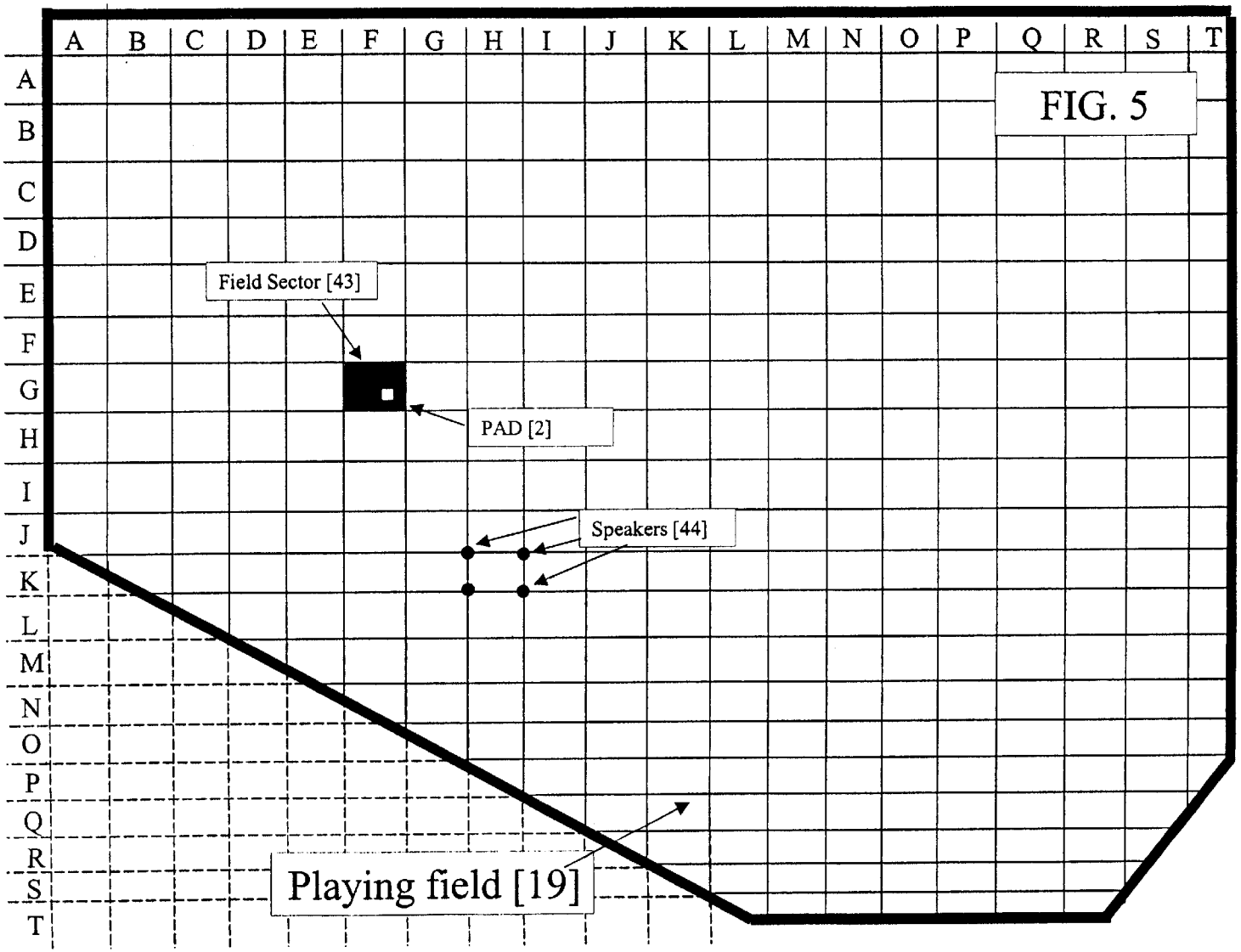
FIG. 5 is a view of an exemplary playing field [19] illustrating the sectioning of the field into Virtual Field Sectors [43] used by the VBS Application Servers [15] and players.

Referring to FIG. 5, a view of an exemplary Virtual Field Sectors [43] used by the VBS Application Servers [15] for calculations and by players for location orientation on the playing field [19] is provided. The exemplary embodiment of FIG. 5 can be modified where suitable to provide functionality of the present invention in other suitable environments and applications. These Virtual Field Sectors [43] are used by the players, the VBS Application Servers [15], and the Special Effects Servers [16] to refer to the location of objectives, to request Virtual Support Services (VSS) into designated coordinates, to calculate VSS requested in designated coordinates, to zone sound effects, lighting, and pyrotechnics into particular areas of the playing field [19].

Figure 6:
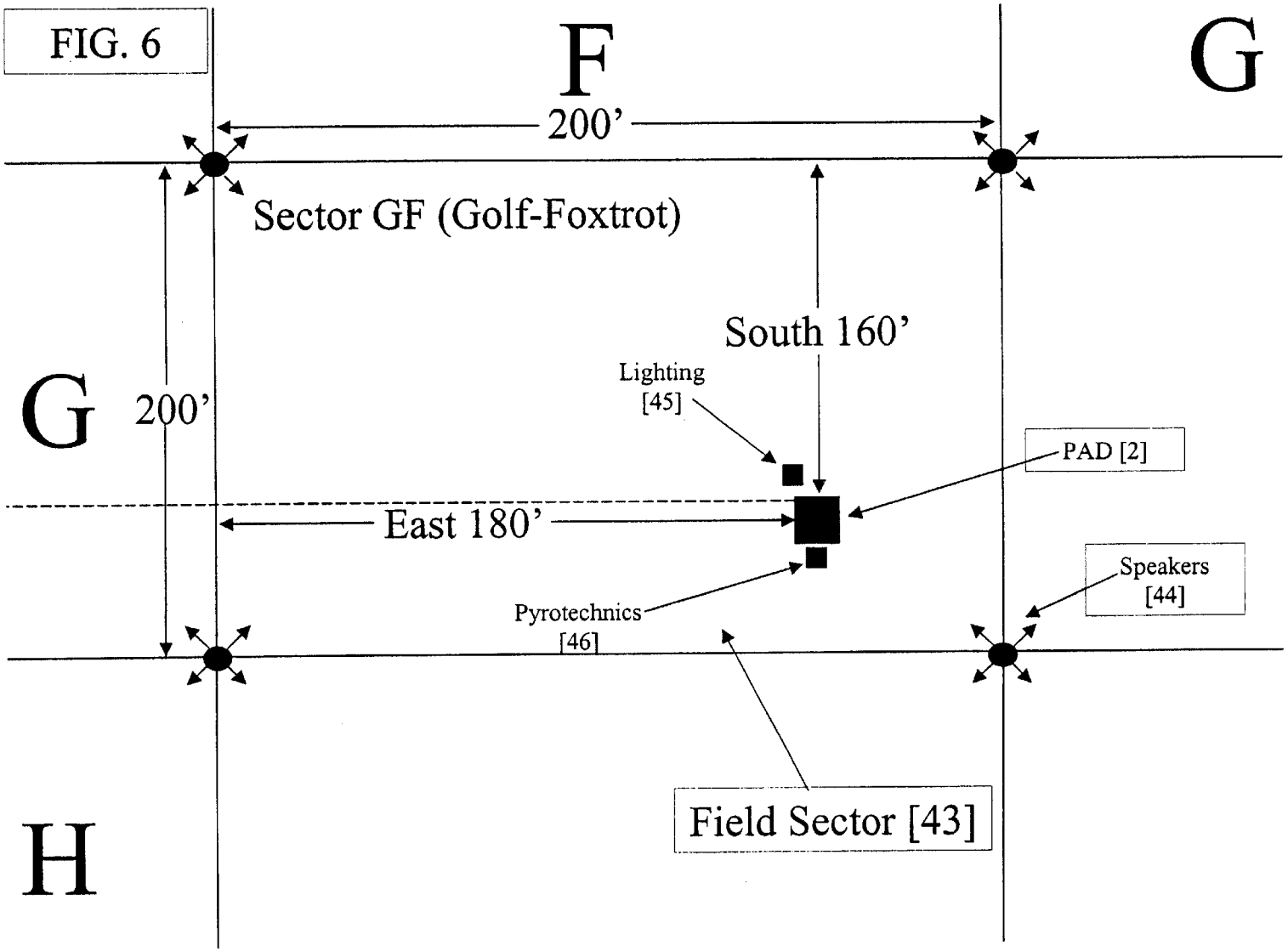
FIG. 6 is a view illustrating an exemplary single Virtual Field Sector [43] on the playing field [19]

The playing field [19] may be broken up into many areas, preferably square areas, known as Virtual Field Sectors [43]. Depending on the playing fields [19] overall size and shape determines the number of Virtual Field Sectors [43] a playing field [19] can have. In FIG. 6 a Virtual Field Sector [43] is approximately an acre in size.

FIG. 5 illustrates a playing field [19] with approximately 400 Virtual Field Sectors [43] as well as illustrating where four speakers [44] would be placed in each sector pointing inward towards the center of the sector for enhanced sound effects. The figure also illustrates an objective with a PAD [2] in a sector for orientation of the field and how objectives are seen to the VBS Application Servers [15]. The speakers may be implemented as directional speakers to direct the sound more precisely and enhance the overall special effects and realistic nature of the present invention.

Referring to FIG. 6, a view showing an exemplary single Virtual Field Sector [43] is shown. The exemplary embodiment of FIG. 6 can be modified where suitable to provide functionality of the present invention in other suitable environments and applications. This illustrates how a player on the field determines the coordinates of an objective when requesting Virtual Support Services (VSS) from the VBS Application Servers [15]. Just like on the real battlefield the soldier has to make an educated guess on where the targeted objective exists inside a sector on a map. The player can try to pinpoint the coordinates of the objective for the Virtual Support Service (VSS). If the player is wrong they may cause the VSS to miss its intended target and do damage in other areas. Remember the players TED [3] will be updated by the VBS Application Servers [15] once a second and display the Virtual Field Sector [43] in the LCD Sector/VPL Display [29]. This provides the player with information on the Virtual Field Sector [43] they are currently in but doesn't inform them of where they are in that sector or their distance to or from an objective. There can be some room for error in order for the game to be more realistic. When the players make a request for a VSS on an objective they can give the Virtual Field Sector [43] and coordinates of that objective within the Virtual Field Sector [43]. This VSS request is made either by two-way radio [10] communication with the VBS Operators, two-way radio [10] communication with the commanders on the playing field [19], or via commanders WWC [4]. The request will give the coordinates in the following manner: The Virtual Field Sector [43] identification (in FIG. 6 it is: GF or Golf-Foxtrot), the number of feet South the objective is (in FIG. 6 it is: 160' or stated: Sierra 1-6-0), the number of feet East the objective is (in FIG. 6 it is: 180' or stated: Echo 1-8-0). So the targeting of an objective would sound like this: Golf-Foxtrot, Sierra 1-6-0, Echo 1-8-0.

FIG. 6 also shows the use of special effects speakers [44], special effects lighting [45], and special effects pyrotechnics [46] on the playing field [19]. This is to illustrate that the special effects may be hardwired, in one embodiment, to the Special Effects Servers [16] via category 5 UTP, coaxial cable, or fiber optic cable and that they are placed to provide an illusion to the players to enhance the experience and realism of the game.

Figure 7:
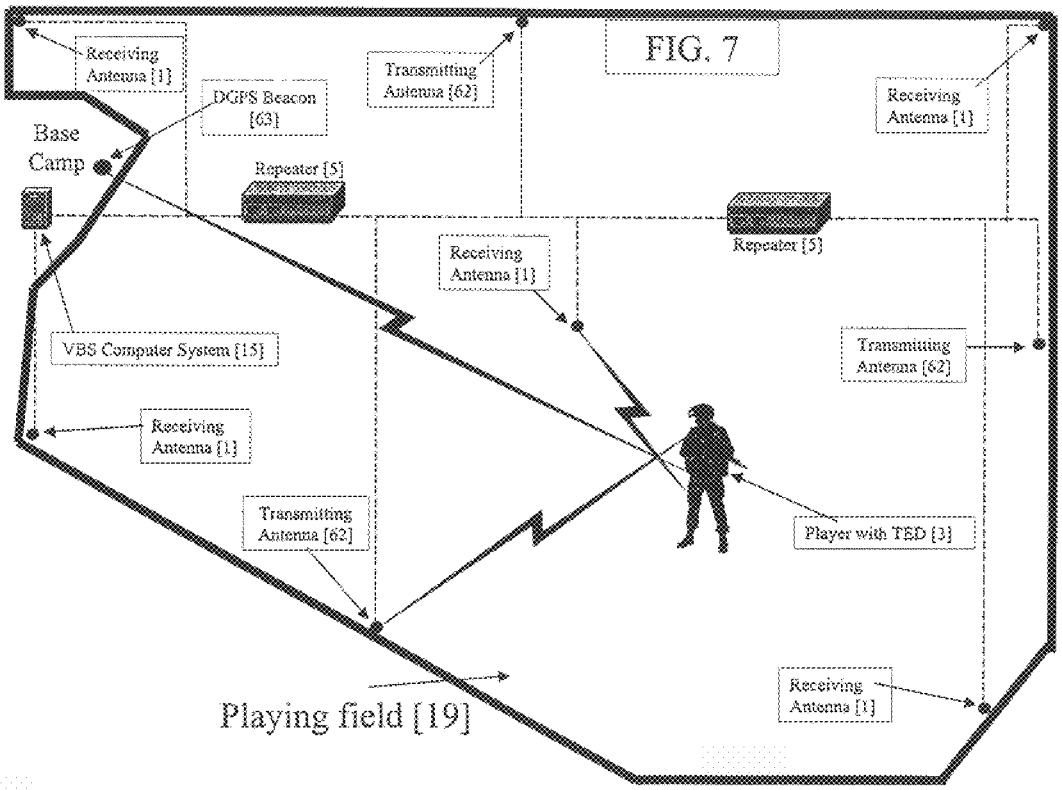
FIG. 7 is a view of an exemplary radio telemetry antenna array, transmitting antenna array [62], and Differential Global Positioning System (DGPS) beacon and how the VBS Application Servers [15] electronically communicate with the players Tracking and Elimination Device (TED) [3]

Referring to FIG. 7, a view illustrating an example of how the VBS Application Servers [15] communicate with the players TED [3] on the playing field [19] is provided. The exemplary embodiment of FIG. 7 can be modified where suitable to provide functionality of the present invention in other suitable environments and applications. As illustrated the receiving antennas [1] are connected to one another using UTP wire, coaxial cable, or fiber optic cable. The transmitting antennas [62] are connected to the VBS Application Servers [15] in the same manner. These hardwired cables contain repeaters where necessary to amplify the signal due to signal loss over long distances. The receiving antenna array [1] then connects to the Antenna Auto-Switch [6] on FIG. 1 which leads to the Digital Spectrum Processor [7], then to the Receiver/Datalogger [9], then to the switches [13], then to the VBS Application Servers [15] for processing. The VBS Application Servers [15] may then send data back to the wireless devices on the playing field [19] in the following manner: (i) from the VBS Application Servers [15] to the switches [13] to the Radio Frequency Transmitter [8], back through the repeaters [5] and on to all the transmitting antennas in the array [62]. The TED [3] may also transmit its current location on the playing field by using the GPS/DGPS receiver [35] located on the TED [3] to receive a signal from the GPS satellites. If the GPS receiver does not calculate very well due to atmospheric conditions and data modifications, resulting in inaccurate TED [3] position information, then the DGPS Beacon [63], which is calibrated to correct the errors received by the TED [3] GPS receiver, eliminates or reduces the inaccuracies by transmitting corrective information to the TED [3] GPS/DGPS receiver [35]. Once the TED [3] has received the corrective information it calculates its position and transmits this information to the VBS Application Servers [15] via the receiving antenna array [1].

Figure 8:
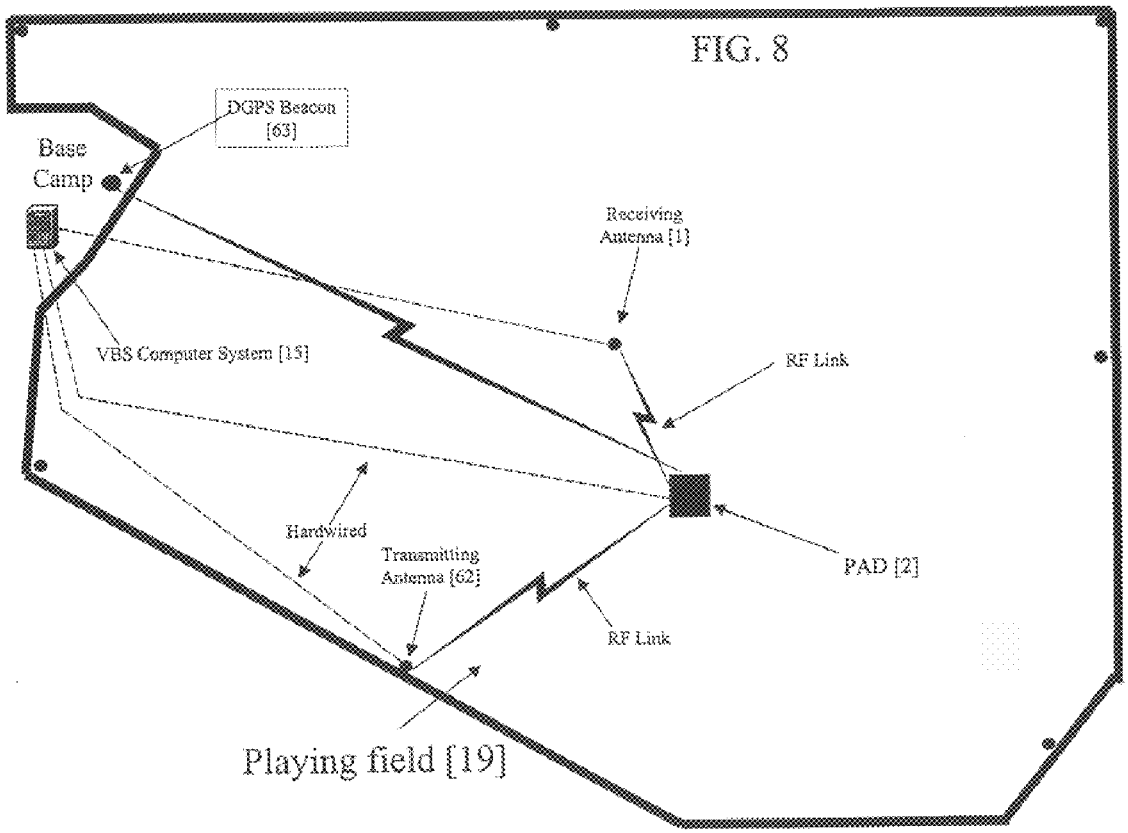
FIG. 8 is a view of an example of how the VBS Application Servers [15] electronically communicate with the Portable Arming Device (PAD) [2] on the playing field [19]

Referring to FIG. 8, a view illustrating an example of how the PAD [2] on the playing field [19] communicates with the VBS Application Servers [15] is provided. The exemplary embodiment of FIG. 8 can be modified where suitable to provide functionality of the present invention in other suitable environments and applications. As illustrated the receiving antennas [1] are connected to one another, in one embodiment, using UTP wire, coaxial cable, or fiber optic cable. The transmitting antennas [62] are connected to the VBS Application Servers [15] in the same manner. These hardwired cables contain repeaters where necessary to amplify the signal due to signal loss over long distances. The receiving antenna array [1] then connects to the Antenna Auto-Switch [6] on FIG. 1 which leads to the Digital Spectrum Processor [7], then to the Receiver/Datalogger [9], then to the switches [13], then to the VBS Application Servers [15] for processing. The VBS Application Servers [15] then send data back to the wireless devices on the playing field [19] in the following manner: From the VBS Application Servers [15] to the switches [13] to the Radio Frequency Transmitter [8], back through the repeaters [5] and on to all the transmitting antennas in the array [62]. The PAD [2] may be hardwired to the VBS Application Servers [15] in the following manner: The PAD [2] is connected to repeaters [5] when necessary by UTP wire, coaxial cable, or fiber optic cable. The repeaters are then connected to the PAD Concentrator [17], illustrated in FIG. 1, via the above hardwires, then connected to the switches [13] and then finally to the VBS Application Servers [15]. This allows the pad to be permanent on the objective and does not require a wireless link. The PAD [2] also transmits its current location on the playing field by using the GPS/DGPS receiver [22] located on the PAD [2] to receive a signal from the GPS satellites. If the GPS receiver does not calculate very well due to atmospheric conditions and data modifications, resulting in inaccurate PAD [2] position information, then the DGPS Beacon [63], which is calibrated to correct the errors received by the PAD [2] GPS receiver by transmitting the corrections to the PAD [2] GPS/DGPS receiver [35], eliminates or reduces the inaccuracies of the GPS receiver. Once the PAD [2] has received the corrective information it calculates its position and transmits this information to the VBS Application Servers [15] via the receiving antenna array [1]. It should be understood that the PAD [2], in other embodiments, may be implemented such that it communicates with the VBS Application Servers [15] using wireless communications instead of hardwired communications lines. In other embodiments, the PAD [2] may not utilize a GPS/DGPS receiver, but instead use non-satellite or local location technology such as spread spectrum, Time Difference of Arrival (TDOA), and Angle of Arrival (AOA) technology.

Figure 10:
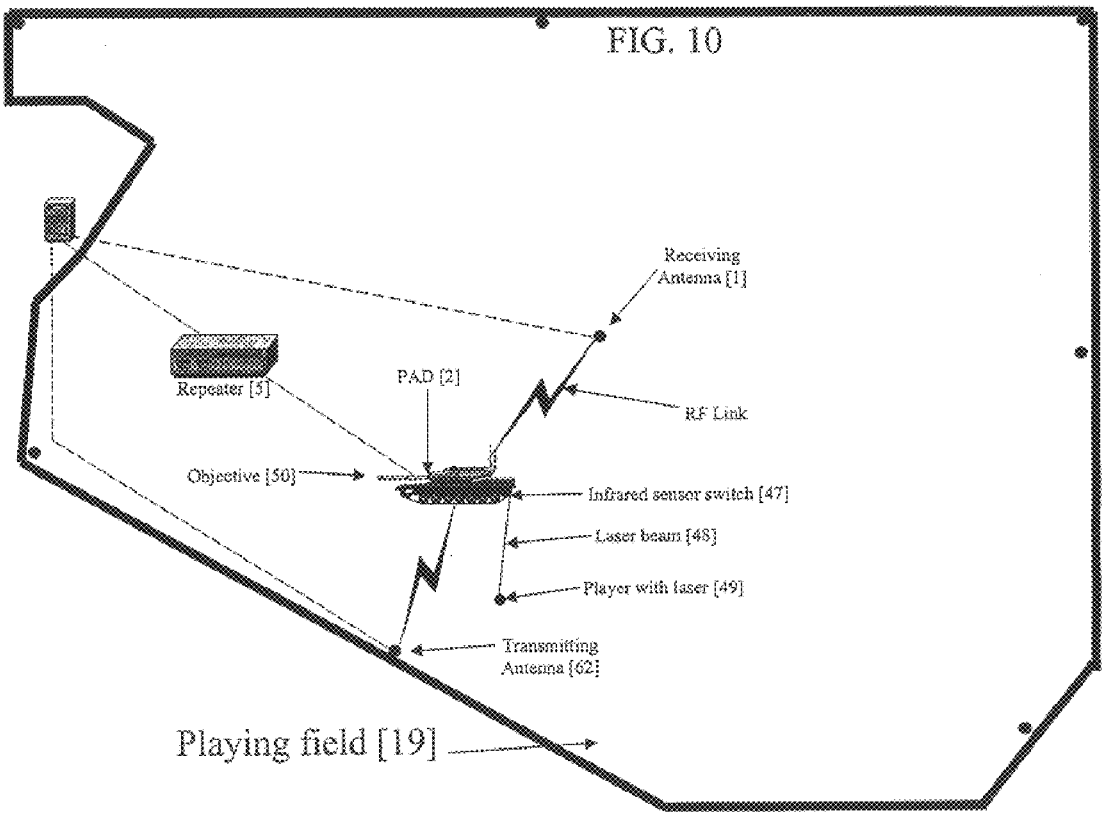
FIG. 10 is a view showing an example of how a player can laser target (Pickle) an objective to be targeted on the playing field [19]. The player using a laser beam triggers an infrared sensor switch on the objective and then calls in a Virtual Support Service (VSS) to gain 100% accuracy in the strike.

FIG. 10 illustrates an example of how a player laser targets (Pickles) an objective to be destroyed. The exemplary embodiment of FIG. 10 can be modified where suitable to provide functionality of the present invention in other suitable environments and applications. The player [49] utilizes a laser beam [48] (such as one used in a laser pen) to activate an infrared sensor switch [47] that is located on the objective [50]. The activation of the infrared sensor switch [47] on the objective [50] notifies VBS Application Servers [15] either wireless or hardwired that the objective [50] has been Pickled. The player then calls in a Virtual Air Strike (VAST), within a specified time, to destroy the objective [50]. The accuracy of the VAST if the objective [50] is Pickled may be at or near 100%.

Figure 11:
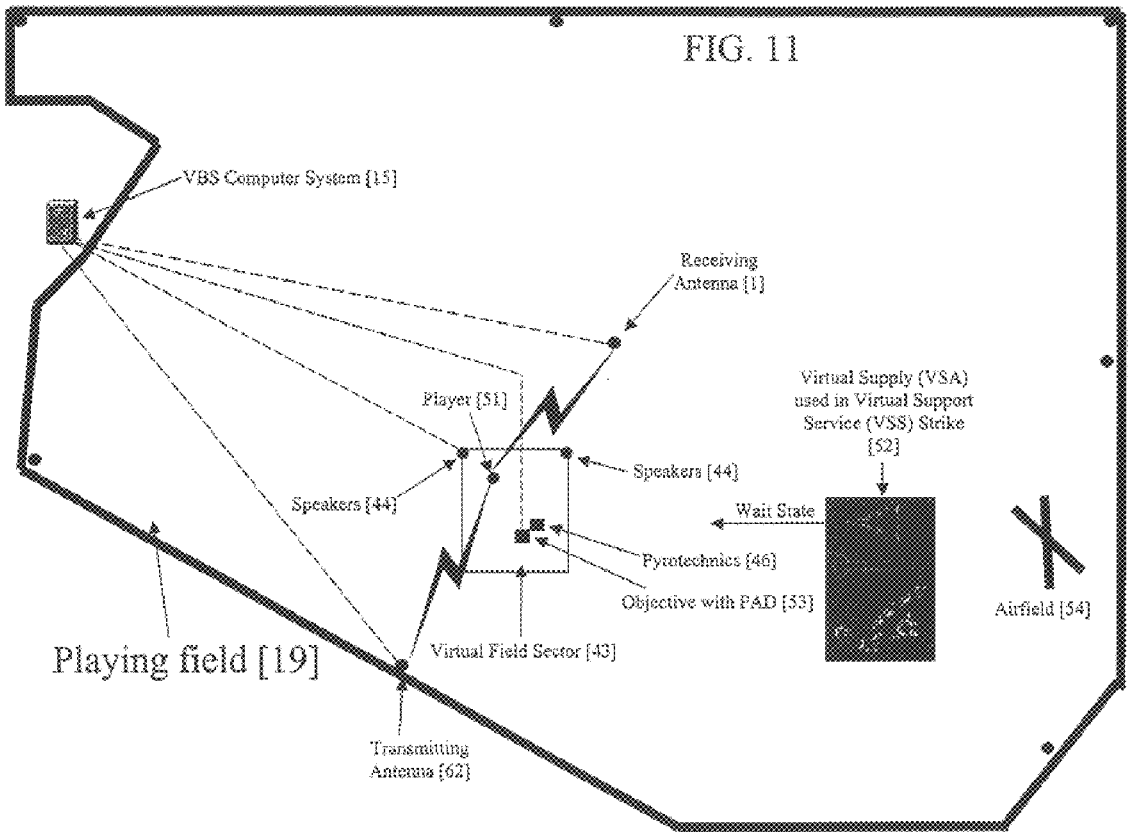
FIG. 11 is an illustration of an exemplary Virtual Support Service (VSS) Strike. This illustration is used to describe Virtual Air Strike (VAST) [52], Virtual Air Defense System (VADS), Virtual Artillery Barrages (VAB) [52], and Virtual Cruise Missiles (VCM) [52] calculated by the VBS Application Servers [15] and notifications sent to players [51] that they are eliminated and the objective [53] is destroyed.

FIG. 11 illustrates an exemplary Virtual Support Services (VSS) Strike. The exemplary embodiment of FIG. 11 can be modified where suitable to provide functionality of the present invention in other suitable environments and applications. This illustration is used to describe Virtual Air Strike (VAST) [52], Virtual Air Defense System (VADS), Virtual Artillery Barrages (VAB) [52], and Virtual Cruise Missiles (VCM) [52] calculated by the VBS Application Servers [15] and notifications sent to players [51] that they are eliminated and the objective [53] is destroyed.

Beginning first with the Virtual Air Strike (VAST), a VAST cannot be requested unless the team has possession of an airfield [54] on the playing field [19], a Virtual Aircraft (VAC) [52] in their Virtual Supply Arsenal (VSA) inventory, and enough Virtual Air to Ground Missiles (VAGM) or Virtual Free-Fall Bombs (VFFB) in their team's Virtual Supply Arsenal (VSA) inventory. If the team meets these requirements the players can request a VAST. After a VAST is requested and approved by the VBS Application Servers [15], the VBS Application Servers [15] then perform a wait state such that the players on the field can wait before the strike happens. Once the wait state has completed, the VBS Application Servers [15] then calculate the VAST. Once this calculation is completed the VBS Application Servers [15] then notify the players [51] of the outcome of the VAST in the following ways: (i) activating a player's TED [3] if they are eliminated; (ii) special effects such as sound through speakers [44], lighting, and or pyrotechnics [46]; (iii) setting the objectives PAD [2] Alarm Light [23] to red.

A description of one embodiment of a Virtual Air Defense System (VADS) is explained next. If a player [51] is designated in the VBS Application Servers [15] as a VADS and the team the player [51] is a member of has Virtual Surface To Air Missiles (VSAM) in their Virtual Supply Arsenal (VSA) inventory then the VBS Application Servers [15] will launch a VSAM at the VAC [52] and subtract one VSAM from the teams VSA inventory. The calculation made by the VBS Application Servers [15] is random in accuracy for the VSAM to strike the VAC [52]. If the VSAM strikes the VAC [52] then the players are notified of the VAC [52] destruction by special effects in that Virtual Field Sector [43]. The VAC [52] is removed from the VSA inventory of the team that called in the VAST.

A description of one embodiment of a Virtual Artillery Barrage (VAB) is provided next. The Virtual Artillery Barrage (VAB) requires the initiating team to be in possession of an artillery gun on the playing field [19] or have a Virtual Artillery Gun (VAT) [52] in their Virtual Supply Arsenal (VSA) inventory. The team that would like to request the VAB can also have enough Virtual Artillery Shells (VAS) in their VSA inventory as well. Once these requirements are met, the team may utilize the Virtual Artillery Barrage (VAB). The VAB is similar to the VAST although the requirements are different and the VAB may have limited distance in range to the target unlike the VAST. As well as less accuracy at greater distances from the teams location of their VAT [52]. The players on the playing field [19] are notified of a VAB in the same manner they are notified during a VAST although the sound effects may be different.

A description of one embodiment of a Virtual Cruise Missile (VCM) is described below. The VCM [52] requires the team to have a VCM [52] in their VSA inventory. Once these requirements are met, the team may request a VCM [52] strike. The VCM [52] has no distance limitations for a target. It does however have a wait state like all other VSS. The VCM [52] only needs to have the Virtual Field Sector [43] given during the request and not the coordinates inside the Virtual Field Sector [43]. The VCM will destroy all objectives [53] within a Virtual Field Sector [43] with 100% accuracy every time and any player within 100' of the objective [53] destroyed will be eliminated as well and notified via TED [3] . The players on the playing field [19] are notified of the VCM [52] in the same manner as the above VSS but with different sound effects.

Figure 12:
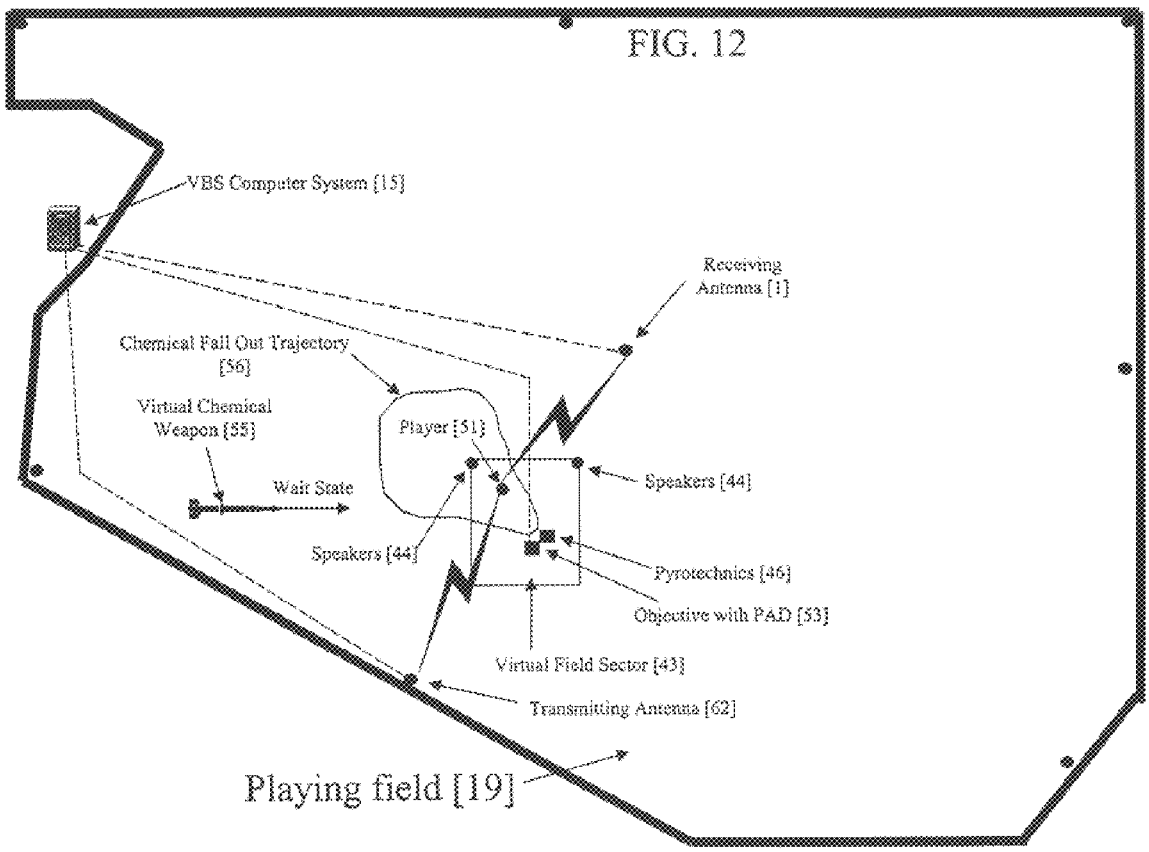
FIG. 12 is an illustration of an exemplary Virtual Chemical Weapon (VCW) strike. VCW [55] is very similar to a Virtual Cruise Missile (VCM) except the VCW [55] cannot destroy an objective. The VCW [55] may also be dependent on the wind speed and direction on the playing field [19]

Referring next to FIG. 12, a view illustrating an exemplary Virtual Chemical Weapon (VCW) is shown. The exemplary embodiment of FIG. 12 can be modified where suitable to provide functionality of the present invention in other suitable environments and applications. A VCW [55] cannot be requested by a player or team unless a VCW [55] is in their Virtual Supply Arsenal (VSA) inventory. A player can request a VCW [55] using only the Virtual Field Sector [43]. The VCW [55] can strike in the center of the Virtual Field Sector [43]. The VCW [55] is calculated using the Wind Speed and Direction Indicator [14] on the playing field [19]. The VCW [55], like other VSS, have a wait state before detonation. The VBS Application Servers [15] calculate the VCW [55] fallout [56] using the Wind Speed Indicator and Direction [14] data. Any player within the VCW [55] fallout [56] is eliminated from play and notified via the player's TED [3]. Players on the playing field [19] are notified of the VCW [55] by way of special effects on the field.

Figure 13:
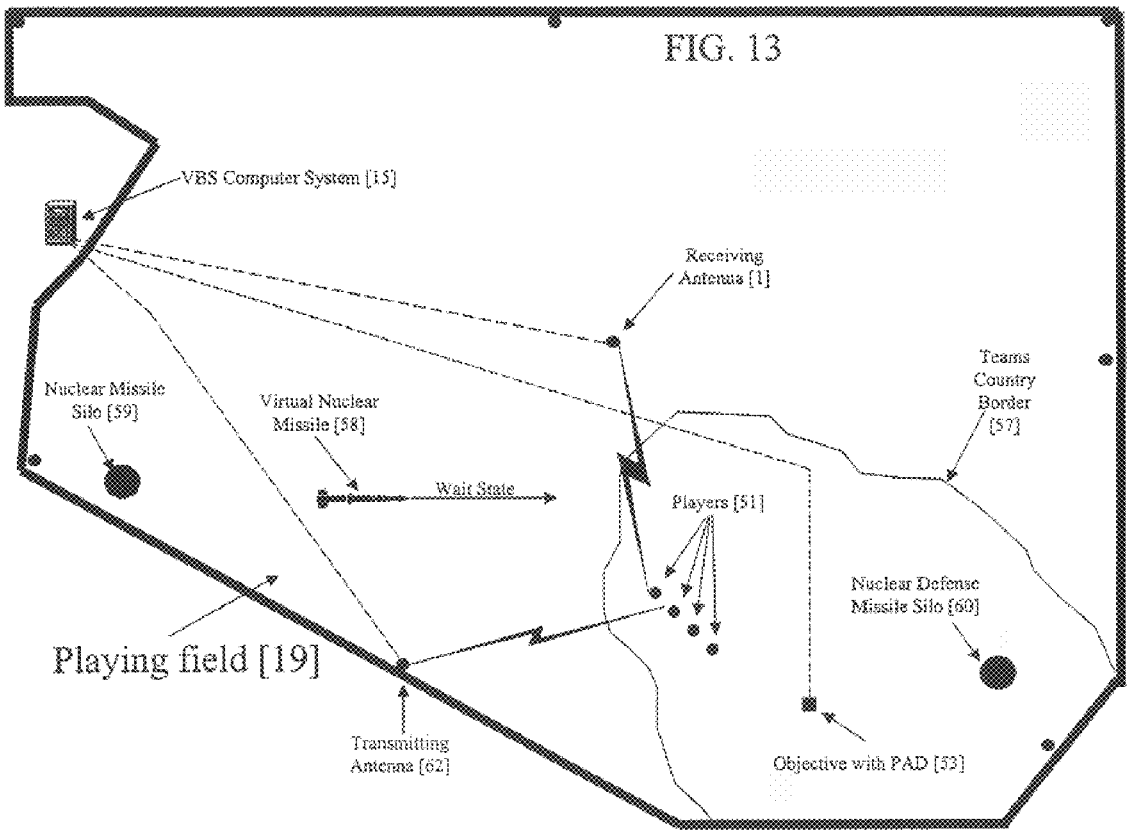
FIG. 13 is an illustration of an exemplary Virtual Nuclear Missile (VNM) strike and Virtual Nuclear Defense Missile (VNDM) activation. VNM [58] is very similar to the Virtual Cruise Missile (VCM) [55] except that the VNM [58] destroys every objective in a team's country [57] and eliminates all players [51] in a team's country [57] as well. The VNDM will eliminate the VNM [58] if the team being target has possession of a Nuclear Missile Defense Silo [60] on the playing field [19] and a Virtual Nuclear Defense Missile (VNDM) in their Virtual Supply Arsenal (VSA) inventory.

Referring to FIG. 13, an illustration of an exemplary Virtual Nuclear Missile (VNM) strike and Virtual Nuclear Defense Missile (VNDM) activation is shown. The exemplary embodiment of FIG. 13 can be modified where suitable to provide functionality of the present invention in other suitable environments and applications. A VNM [58] request requires the team to be in possession of a Nuclear Missile Silo [59] on the playing field [19] as well as having a VNM [58] in their Virtual Supply Arsenal (VSA) inventory. If the team meets the requirements above, they can request a VNM [58] strike. Only the commander of the team can request a VNM [58]. The commander requests the VNM [58] by supplying the VBS Application Servers [15] with the country that is being targeted. Once the VBS Application Servers [15] approve the request, sound effects are played in the targeted country to warn the targeted team of a VNM [58] launch targeted towards them. The targeted team will here an alarm sound for 15 minutes indicating for the players [51] to leave the country or be eliminated. The 15 minutes acts as the wait state for the VNM [58] strike. Once the 15 minute wait state has been reached, all objectives in the targeted country will be destroyed and all the players [51] in the country will be eliminated. The players [51] on the playing field [19] will be notified of their elimination and objective destruction by activation of their TED [3] alarms and activation of the PAD [2] Alarm light [23] and special effects.

Referring still to FIG. 13, if the targeted team is in possession of a Nuclear Missile Defense Silo [60] and a Virtual Nuclear Defense Missile (VNDM) in their Virtual Supply Arsenal (VSA) inventory, the VBS Application Servers [15] will subtract one VNDM from the targeted teams VSA inventory and launch the VNDM and destroy the threatening VNM [58] within 1 minute of its launch. Thus eliminating the threat of the VNM [58] to that country. The players [51] on the playing field [19] will be notified via special effects that the VNM [58] threat has vanished.

Figure 14:
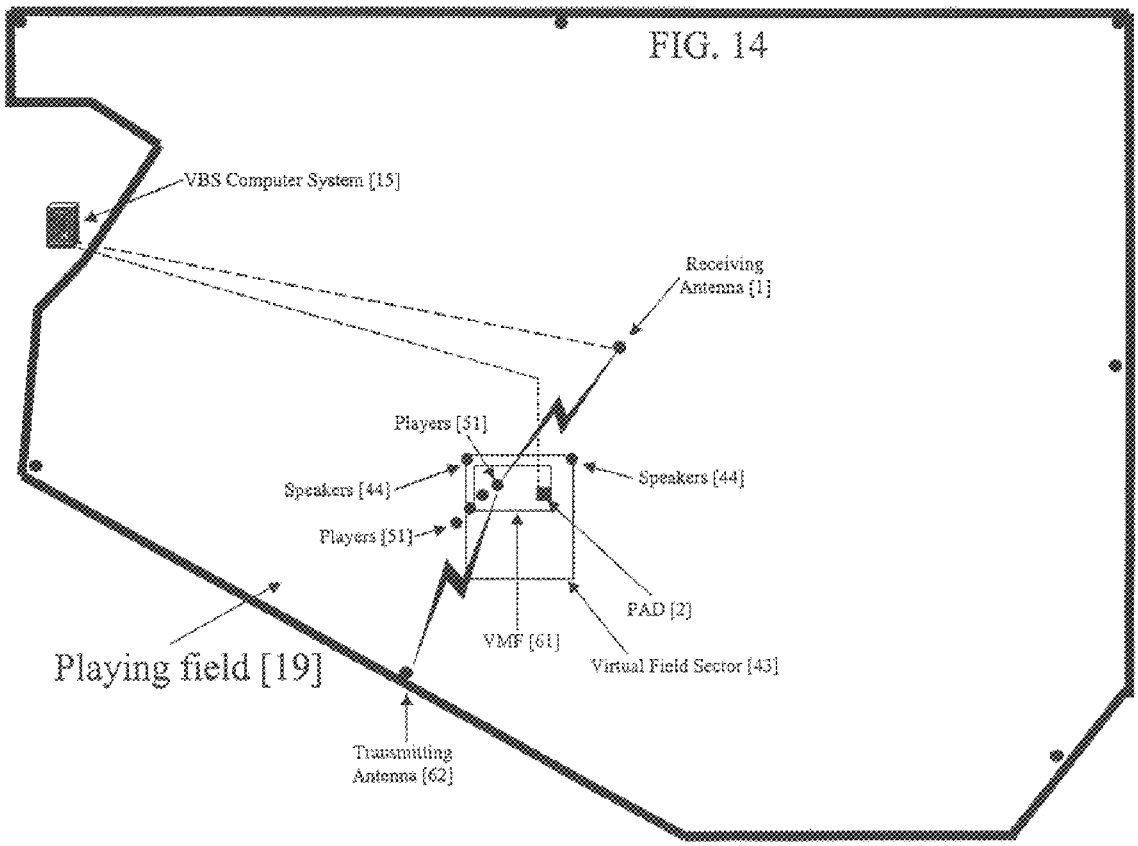
FIG. 14 is an illustration of an exemplary Virtual Minefield (VMF). VMF [61] are virtual areas designated by the VBS Application Servers [15] as VMF [61]. VMF [61] can range in size from 50 feet to an entire Virtual Field Sector [43]. When a player [51] enters a VMF [61] and they are not designated by the VBS Application Servers [15] as minesweepers they are eliminated immediately by the VBS Application Servers [15]
Figure 15A:
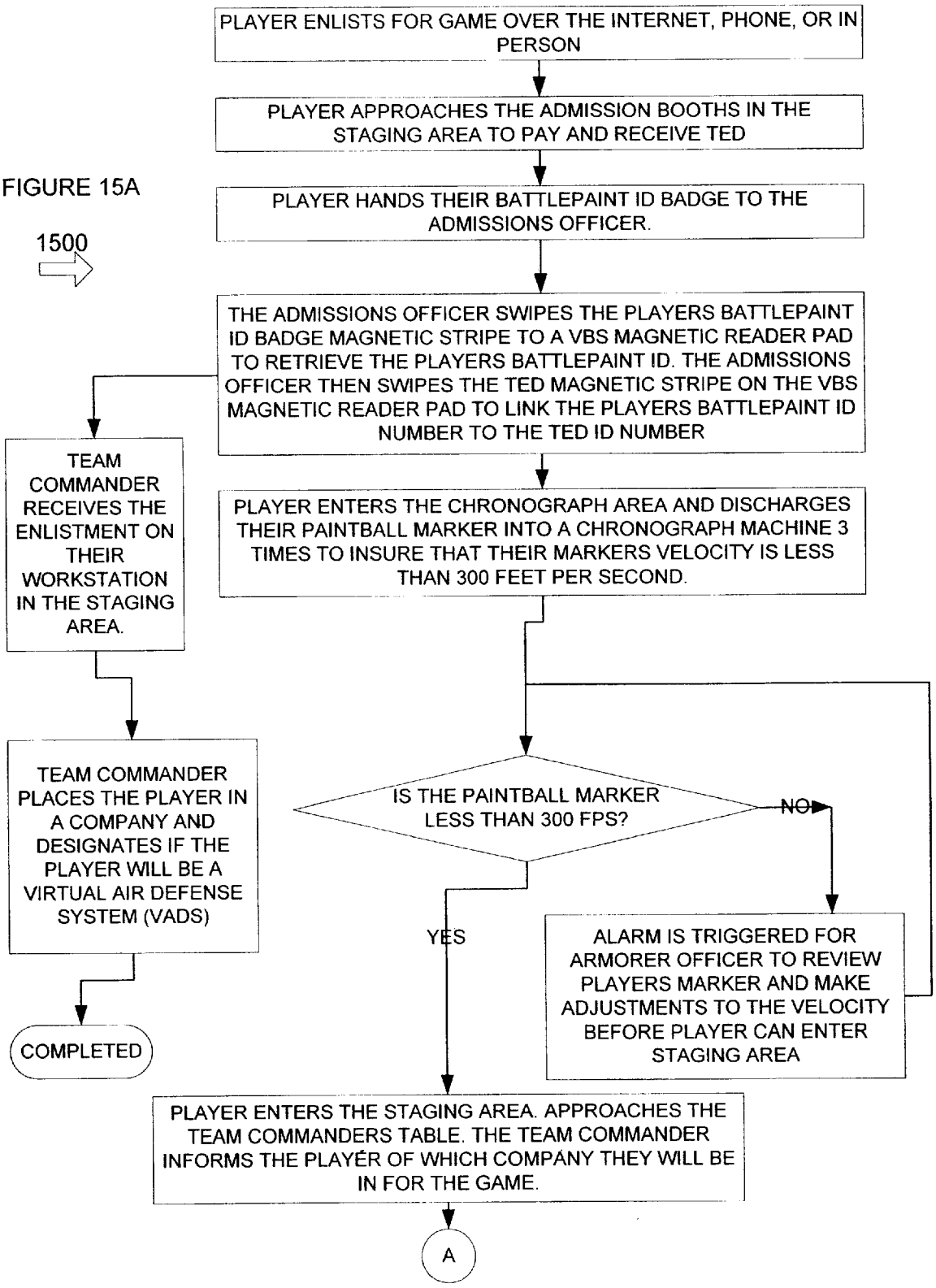
FIGS. 15A through 15K are a flowchart that illustrates various exemplary embodiments and aspects of some of the methods and processes of the present invention.
Figure 15B:
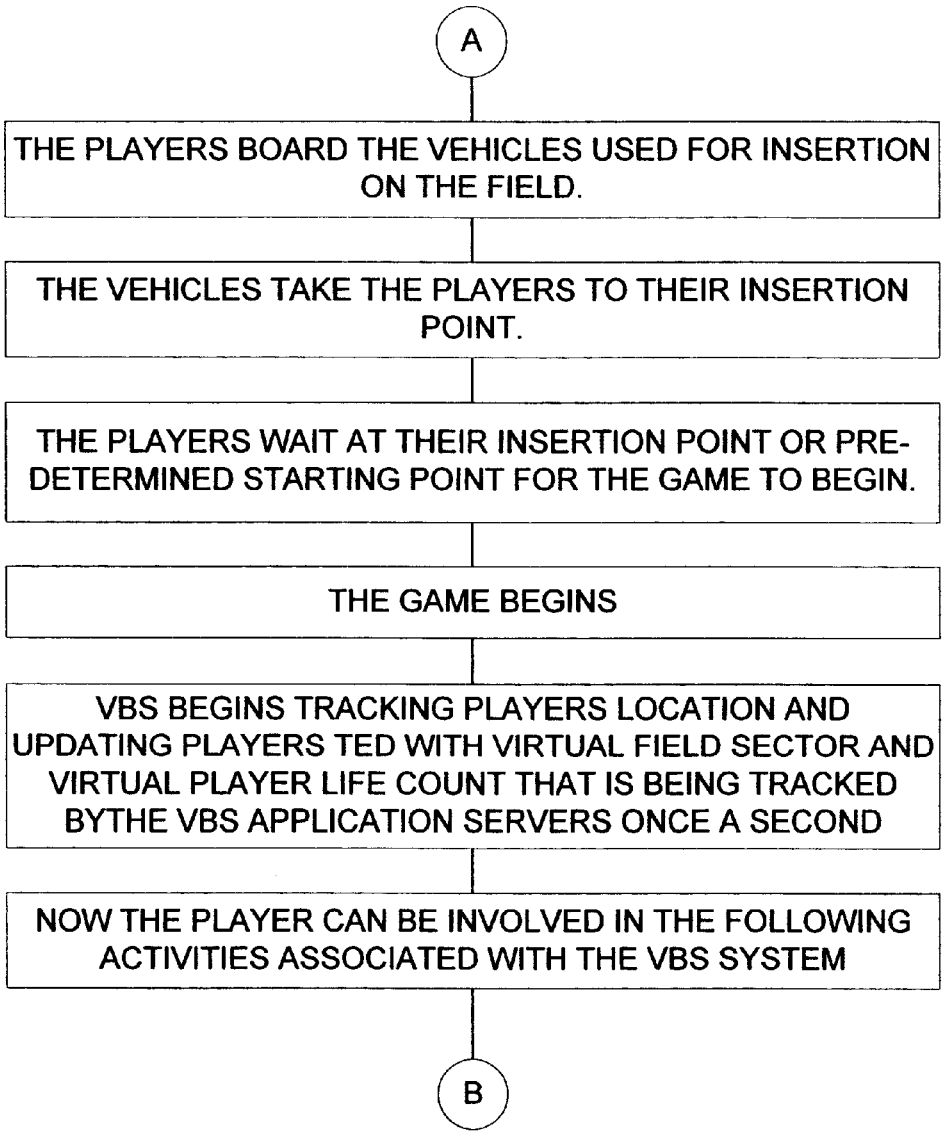
Figure 15C:
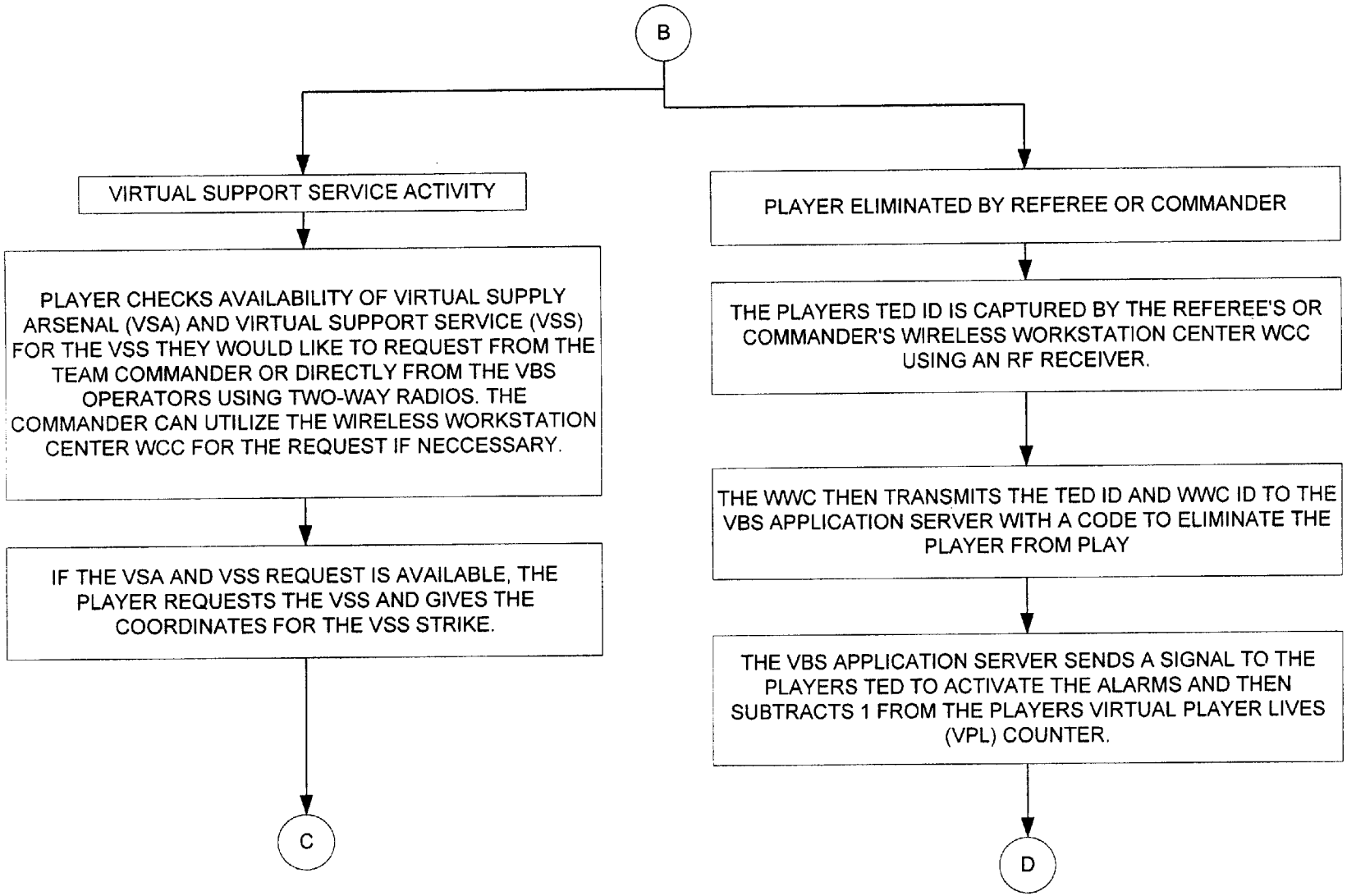
Figure 15D:
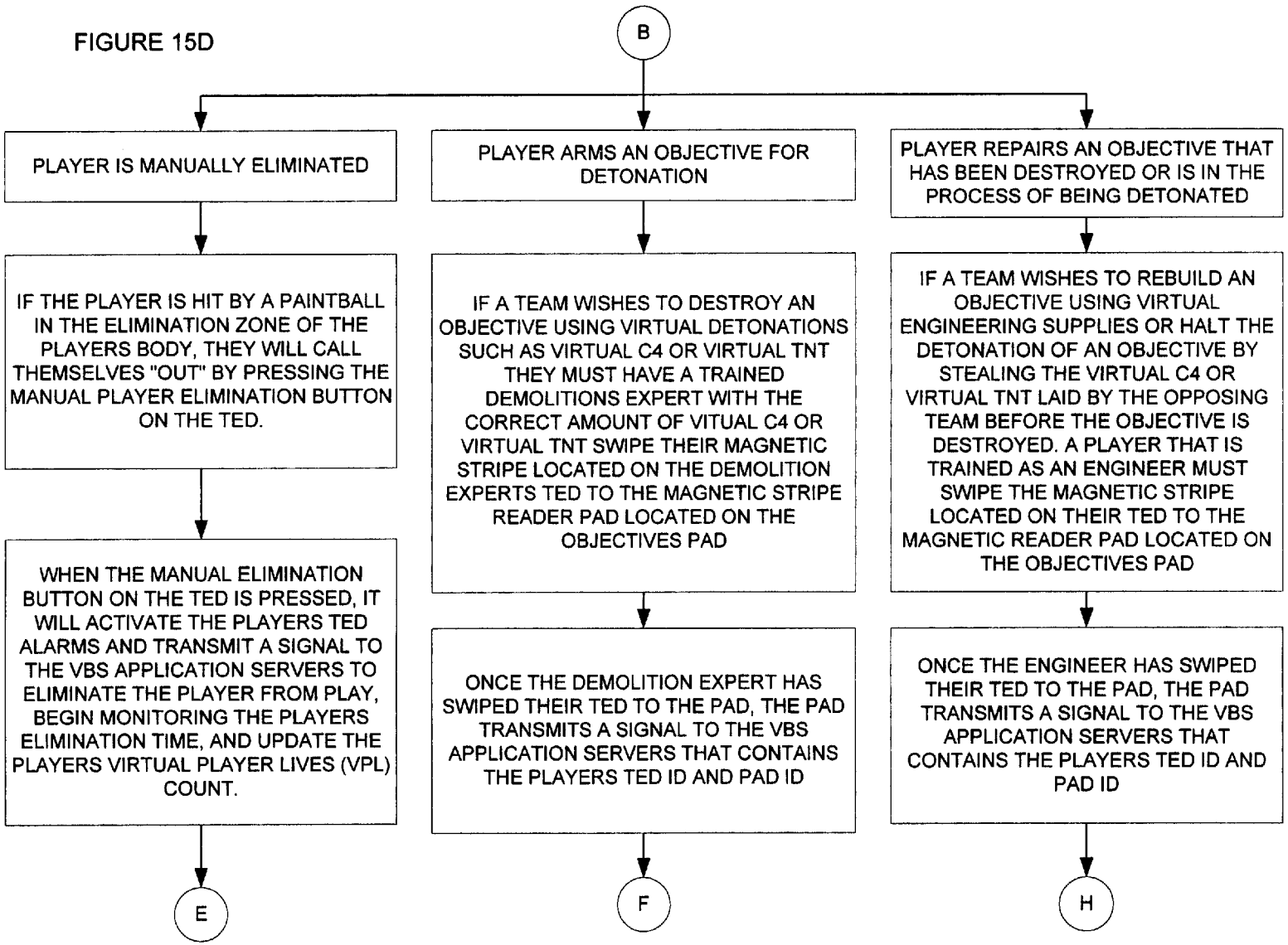
Figure 15E:
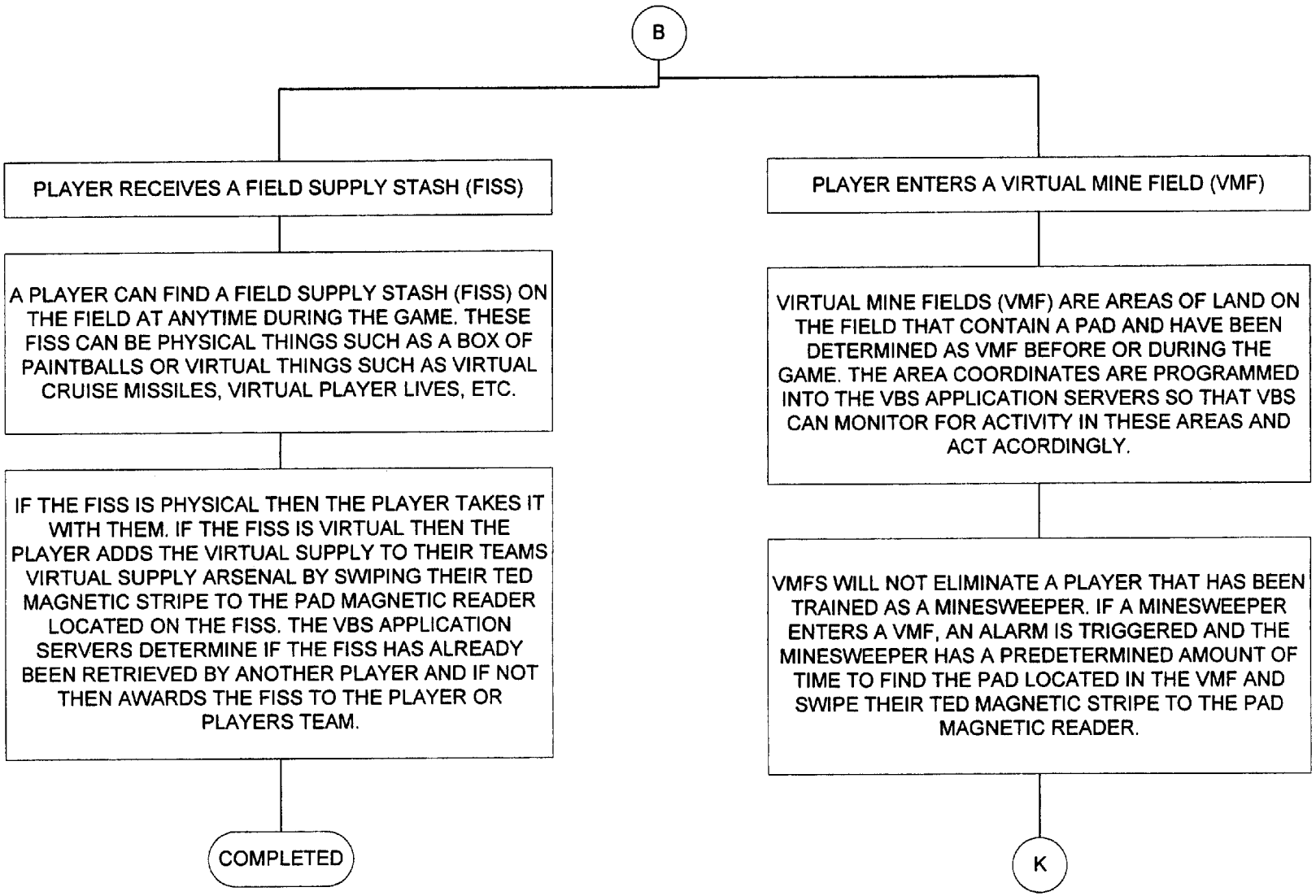
Figure 15F:
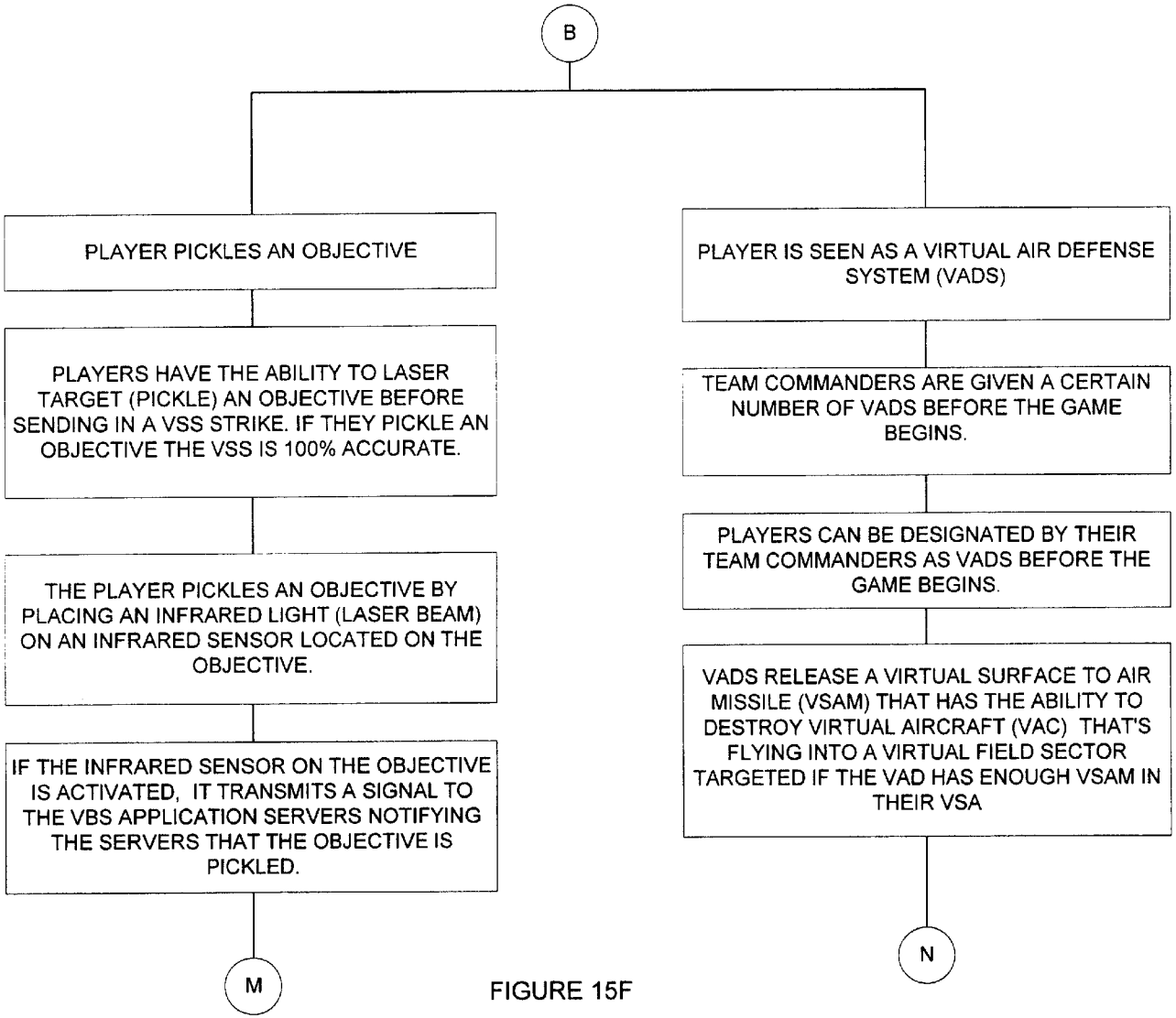
Figure 15G:
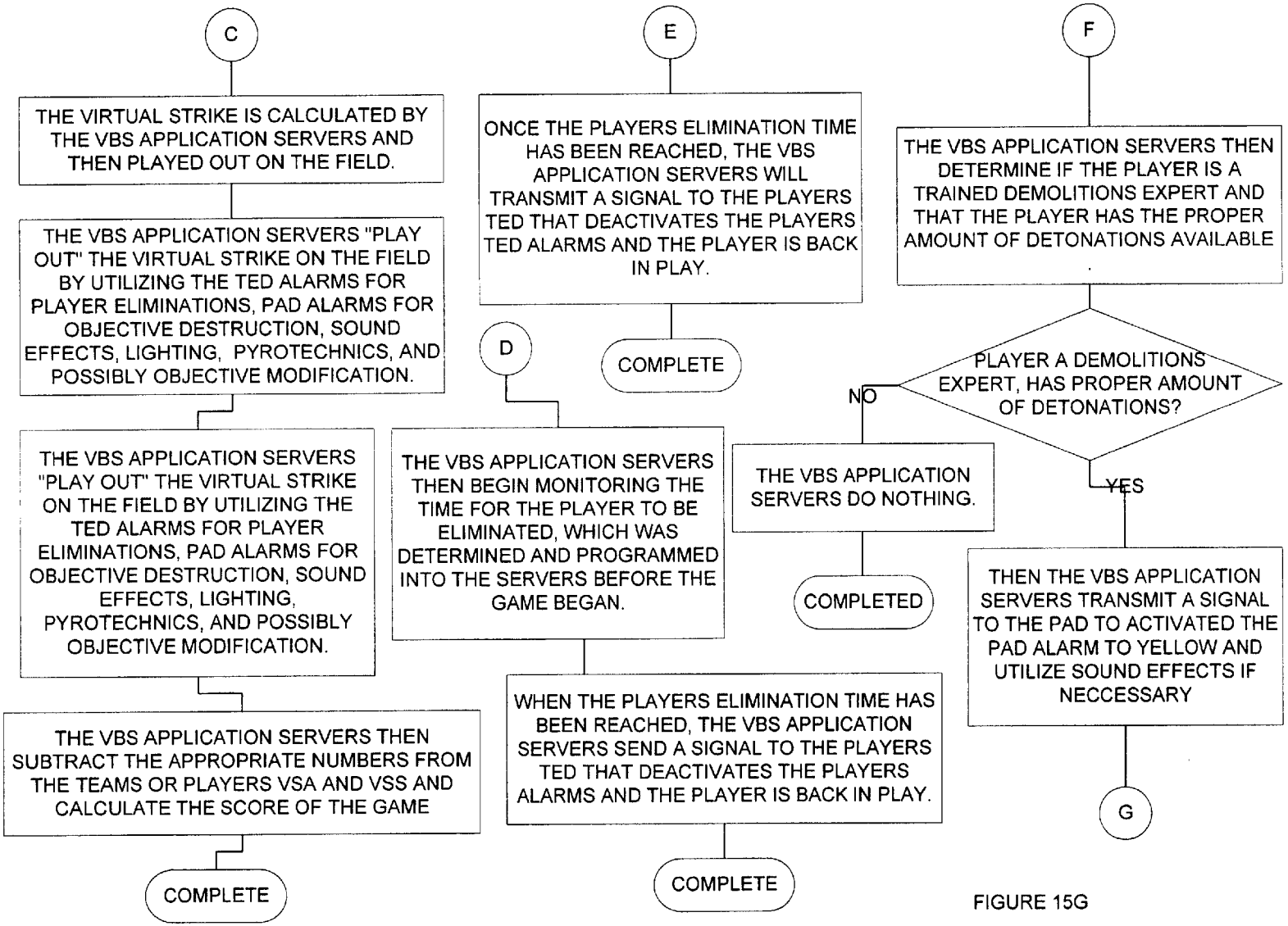
Figure 15H:
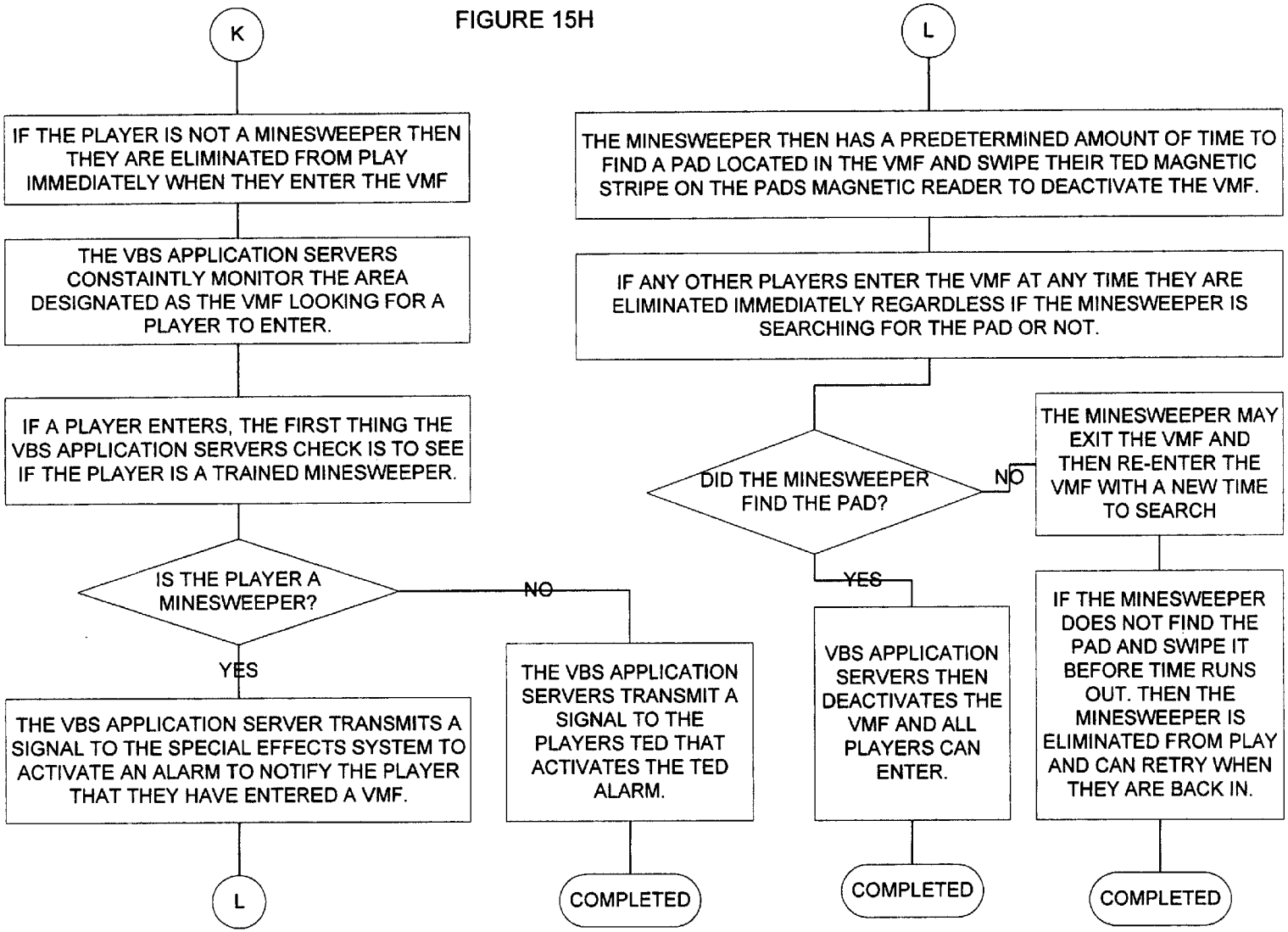
Figure 15I:
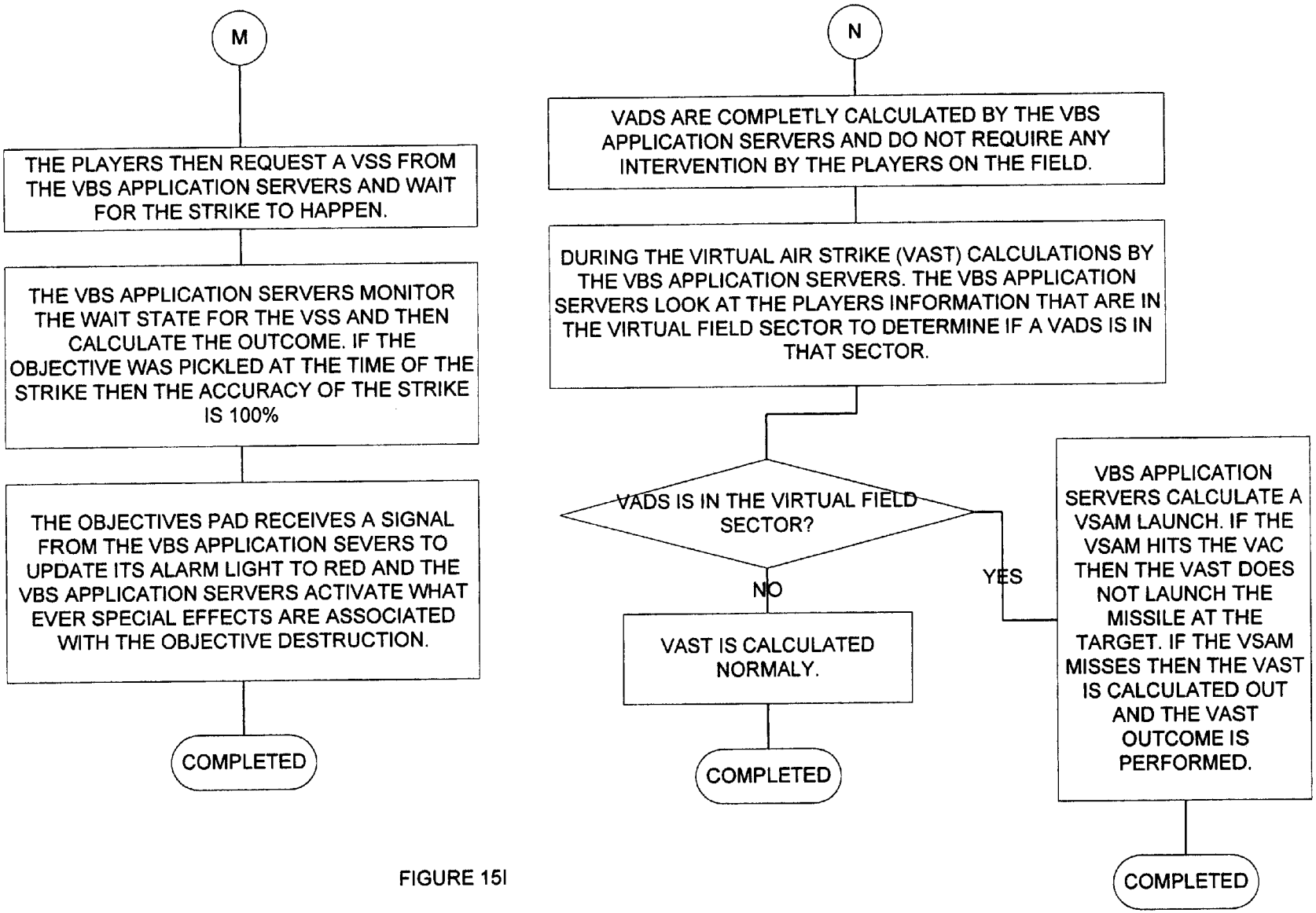
Figure 15J:
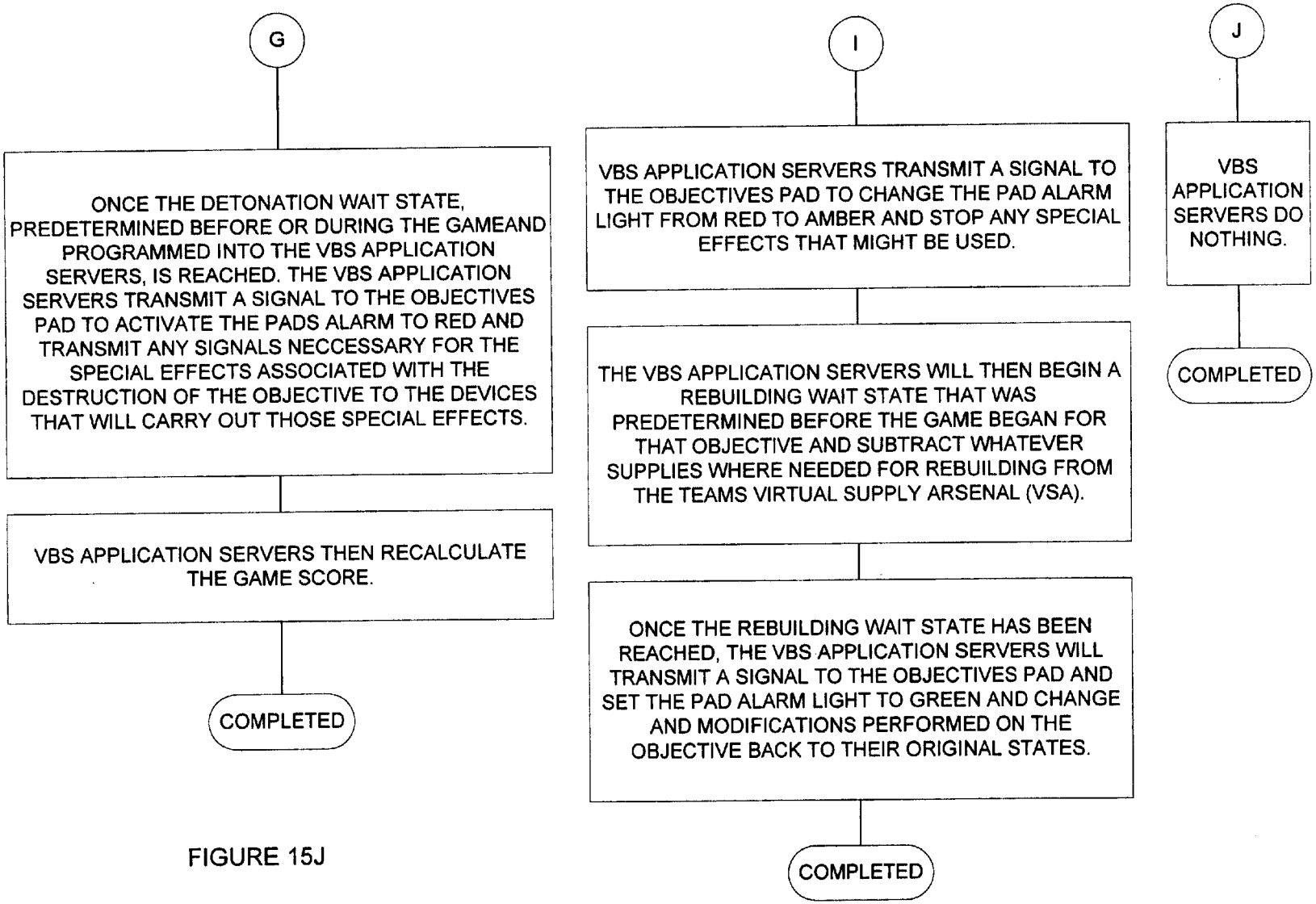
Figure 15K:
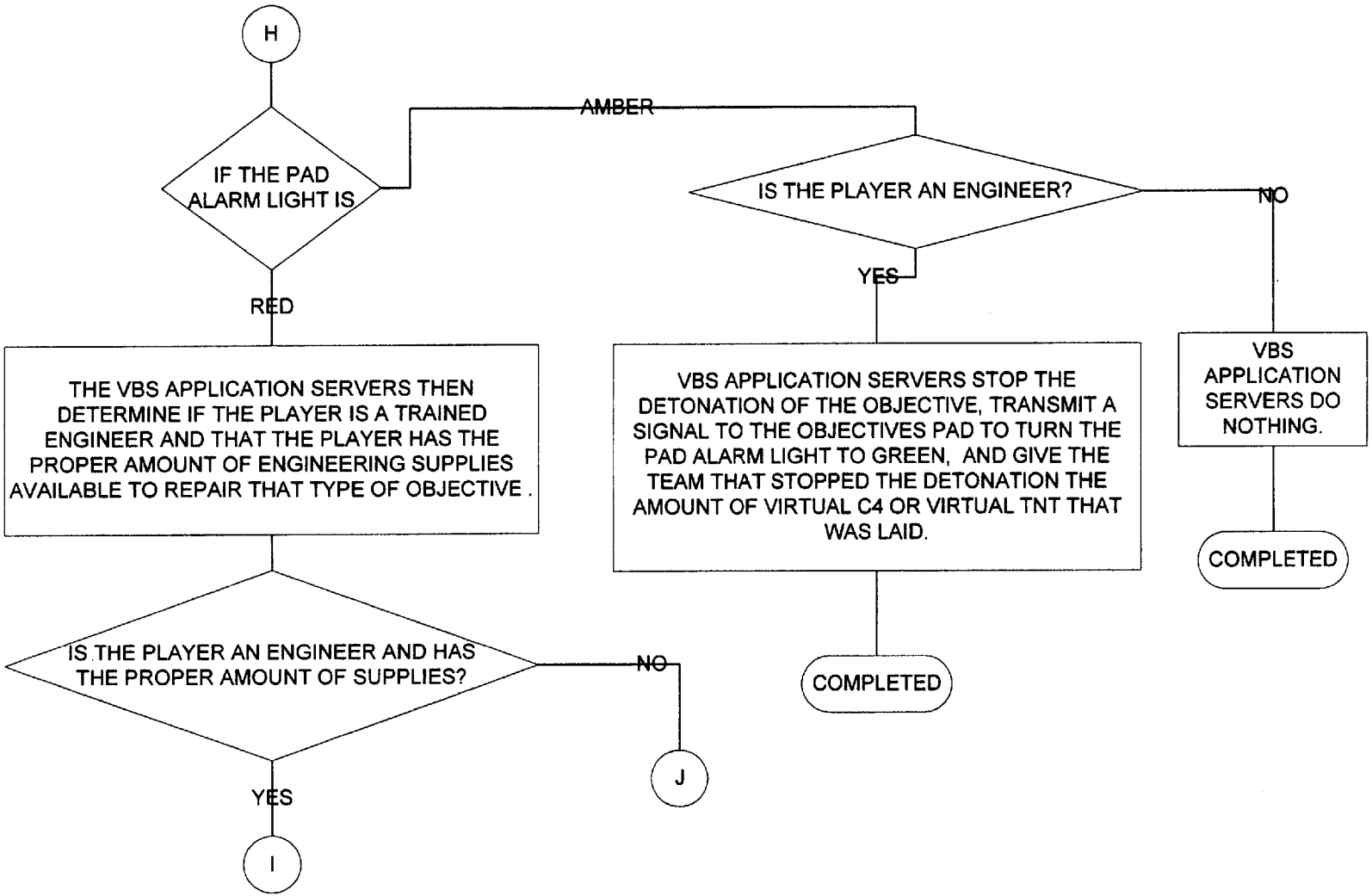

Referring to FIG. 14, an illustration of an exemplary Virtual Minefield (VMF) is provided. The exemplary embodiment of FIG. 14 can be modified where suitable to provide functionality of the present invention in other suitable environments and applications. VMF [61] are virtual areas designated by the VBS Application Servers [15] as VMF [61]. VMF [61] can range in size from 50 feet to an entire Virtual Field Sector [43]. When a player [51] enters a VMF [61] and they are not designated by the VBS Application Servers [15] as minesweepers they are eliminated immediately by the VBS Application Servers [15]. If the player [51] has been determined as a minesweeper by the system then the VBS Application Servers [15] activate a sound effect in the Virtual Field Sector [43] to inform the player [51] that they have entered a VMF [61] . The minesweeper player [51] can find a PAD [2] located in the VMF [61] and disarm the VMF [61] by using their TED [3] magnetic stripe [34] on the PAD [2] magnetic stripe reader pad [24]. This informs the VBS Application Servers [15] that the minesweeper has found the PAD [2] and deactivated the VMF [61]. Any other players [51] that enter the VMF [61] when it is still activated will be eliminated by the VBS Application Servers [15] immediately. The players are notified of elimination via their TED [3] alarms and special effects on the playing field [19].

FIGS. 15A through 15K are a flowchart that illustrates various exemplary embodiments and aspects of some of the methods and processes of the present invention. The flowchart illustrates methods and processes of a player or personnel, along with various method or processes of systems and devices of the present invention, including the virtual battlefield simulator application.

In view of the above detailed description of the present invention and associated drawings, other modifications and variations will now become apparent to those skilled in the art. It should also be apparent that such other modifications and variations may be effected without departing from the spirit and scope of the present invention.

What is claimed is:

1. A virtual battlefield simulator system for simulating a game with a plurality of players, the virtual battlefield simulator system comprising:

a wireless communications link;

a plurality of mobile communications devices;

a plurality of objective communications devices; and a virtual battlefield simulator application server in communication with the plurality of mobile communications devices and the plurality of objective communications devices through the wireless communications link and operable to track the score of the battlefield game, to track and display the location of the plurality of mobile communications devices, to track the number of lives associated with the plurality of mobile communications devices, to track a virtual supply arsenal inventory, to receive a request for a virtual support service, and to execute the requested virtual support service.

2. The virtual battlefield simulator system of claim 1, wherein the virtual battlefield simulator application server initiates a special effect in response to a communication from one of the plurality of objective communications devices, and further comprising:

a special effect generator communicating with the virtual battlefield simulator application server and displaying the special effect.

3. The virtual battlefield simulator system of claim 2, wherein the special effect generator is a speaker.

4. The virtual battlefield simulator system of claim 2, wherein the special effect generator includes pyrotechnics.

5. The virtual battlefield simulator system of claim 1, further comprising:

a special effects server communicating with the plurality of objective communications devices through the wireless communications link and initiating a special effect; and a special effect generator communicating with the special effects server and displaying the special effect.

6. The virtual battlefield simulator system of claim 1, wherein the plurality of objective communications devices are portable arming devices.

7. The virtual battlefield simulator system of claim 1, wherein the plurality of mobile communications devices are tracking and elimination devices.

8. A virtual battlefield simulator application comprising:

a database storing score information, objective communications device information, location information, mobile communications device information, lives information, virtual supply arsenal inventory information, and virtual support services information;

a score module calculating and tracking the score of the battlefield game and storing the score of the battlefield game using the score information of the database;

an objectives module exchanging information with a plurality of objective communications devices, maintaining the status of the plurality of objective communications devices, and storing the objective communications device information of the database;

a location module receiving location information that indicates the location of a plurality of mobile communications devices, displaying the location information, and storing the location information of the database;

a lives module communicating with the plurality of mobile communications devices, tracking the number of lives associated with the plurality of mobile communications devices, and storing the lives information of the database;

a virtual supply arsenal module tracking a virtual supply arsenal inventory and storing the virtual supply arsenal inventory information of the database; and a virtual support services module receiving a request from a mobile communications device for a virtual support service, verifying that an adequate virtual supply arsenal inventory exists for the requesting mobile communications device to execute the requested virtual support service, updating the virtual supply arsenal inventory, executing the requested virtual support service, determining the effect of the virtual support service on the lives of the plurality of mobile communications devices and the status of the plurality of objective communications devices, and storing the virtual support services information of the database.

9. The virtual battlefield simulator application of claim 8, wherein the virtual support services module tracks virtual support services information by player.

10. The virtual battlefield simulator application of claim 8, wherein the plurality of players are grouped into teams and the virtual support services module tracks virtual support services information by teams.

11. The virtual battlefield simulator application of claim 8, wherein the virtual supply arsenal module tracks virtual supply arsenal inventory information by player.

12. The virtual battlefield simulator application of claim 8, wherein the plurality of players are grouped into teams and the virtual supply arsenal module tracks virtual supply arsenal inventory information by teams.

13. A tracking and elimination device comprising:

a location receiver determining the current position of the tracking and elimination device;

a wireless transceiver communicating with a wireless communications link to receive and transmit information;

a status indicator communicating tracking and elimination device status information; and a manual switch indicating the a life has been lost and updating the lives information accordingly.

14. The tracking and elimination device of claim 13 further comprising a display displaying the current position of the tracking and elimination device as determined by the location receiver and to display lives information.

15. The tracking and elimination device of claim 13 wherein the current position of the tracking and elimination device is one of two or more field sectors.

16. A portable arming device for use as an objective communications device in a battlefield game that includes a wireless communications link, the portable arming device comprising:

a location receiver determining the current position of the portable arming device;

a wireless transceiver communicating with a wireless communications link to receive and transmit information;

an input device arming the portable arming device for detonation and disarming the portable arming device for detonation; and a status indicator indicating that the portable arming device is armed for detonation.

17. The portable arming device of claim 16 wherein the status indicator further indicates that the portable arming device is not armed for detonation and that the portable arming device has been destroyed.

18. The portable arming device of claim 16 wherein the status indicator further comprises a special effects server.

19. The portable arming device of claim 16 wherein the status indicator further indicates that the portable arming device is being repaired and that the portable arming device has been repaired.

20. The portable arming device of claim 16 wherein the current position is one of two or more field sectors.

* * * * *